US011839313B2

(12) United States Patent
Skilnick et al.

(10) Patent No.: US 11,839,313 B2
(45) Date of Patent: Dec. 12, 2023

(54) ADJUSTABLE BABY BOUNCER

(71) Applicant: The ERGO Baby Carrier, Inc., Torrance, CA (US)

(72) Inventors: Edward William Skilnick, Mission Viejo, CA (US); Kevin Dann Scheiferstein, Long Beach, CA (US); Eric William Childs, San Diego, CA (US); Rodney V. Telford, Eagle Point, OR (US)

(73) Assignee: The ERGO Baby Carrier, Inc., Torrance, CA (US)

( * ) Notice: Subject to any disclaimer, the term of this patent is extended or adjusted under 35 U.S.C. 154(b) by 0 days.

(21) Appl. No.: 18/107,268

(22) Filed: Feb. 8, 2023

(65) Prior Publication Data

US 2023/0190010 A1 Jun. 22, 2023

Related U.S. Application Data

(63) Continuation of application No. 17/898,719, filed on Aug. 30, 2022, now Pat. No. 11,576,499.

(Continued)

(51) Int. Cl.
*A47D 13/10* (2006.01)
*A47D 1/00* (2006.01)

(52) U.S. Cl.
CPC ..... *A47D 13/107* (2013.01); *A47D 1/002* (2013.01)

(58) Field of Classification Search
CPC ..... A47D 13/107; A47D 1/002; A47D 13/10; A47D 15/006; A47D 13/101
See application file for complete search history.

(56) References Cited

U.S. PATENT DOCUMENTS 2,460,308 A * 2/1949 Pribil ..... A47D 15/008 5/655
4,383,713 A * 5/1983 Roston ..... A47D 15/003 5/655

(Continued)

FOREIGN PATENT DOCUMENTS

CA 163911 S 3/2015
CN 206896164 U 1/2018

(Continued)

OTHER PUBLICATIONS

"Munchkin Brica XtraGuard Head Support & Strap Cover for Baby Car Seats with Silver-Ion Technology" 1996-2023, Amazon.com, Inc. https://www.amazon.com/Munchkin-XtraGuard-Support-Silver-Ion-Technology/dp/B09SZS5XBK/ref=sr_1_1?crid=1I4DXQDC14HLV&keywords=munchkin+brica+extra+guard+head+support&qid=1675697523&sprefix=munchkin+Brica+Xtra+%2Caps%2C127&sr=8-1.

(Continued)

*Primary Examiner* — Milton Nelson, Jr.
(74) *Attorney, Agent, or Firm* — Erise IP, P.A.

(57) ABSTRACT

A baby bouncer comprising a telescopic base, a seat, and an insert. The telescopic base comprises an outer shell portion and an inner extending portion located at least partially within the outer shell portion; an adjustable upper support pivotally coupled to the telescopic base; a connection limb having a first end operatively coupled to the adjustable upper support and a second end operatively coupled to the inner extending portion; an actuation pedal for adjusting an angle of the adjustable upper support in relation to the telescopic base; and a safety lock disposed on the telescopic base. The bouncer seat has a receiving area and an attachment pocket. The removable insert is received in the receiving area of the seat and receives an infant.

29 Claims, 15 Drawing Sheets

Related U.S. Application Data

(60) Provisional application No. 63/292,237, filed on Dec. 21, 2021.

(56) References Cited

U.S. PATENT DOCUMENTS

| | | | | |
|---|---|---|---|---|
| 5,127,120 | A * | 7/1992 | Mason | B60N 2/2881 297/229 |
| 6,341,818 | B1 * | 1/2002 | Verbovszky | B60N 2/2881 297/219.12 |
| 6,877,802 | B2 | 4/2005 | Christensen et al. | |
| 7,779,490 | B2 | 8/2010 | Bergkvist | |
| 7,780,236 | B2 | 8/2010 | Bergkvist | |
| D692,680 | S | 11/2013 | Bergkvist et al. | |
| D773,838 | S | 12/2016 | Ejvinsson et al. | |
| 9,579,996 | B2 | 2/2017 | Gaudreau, Jr. et al. | |
| 9,713,392 | B2 | 7/2017 | Vinje Brustad et al. | |
| D832,602 | S | 11/2018 | Elmberg et al. | |
| 2009/0165209 | A1 | 7/2009 | Bergkvist | |
| 2009/0200844 | A1 * | 8/2009 | Tibaldo | A47D 13/10 297/219.12 |
| 2009/0256408 | A1 | 10/2009 | Bergkvist | |
| 2015/0289678 | A1 | 10/2015 | Vinje Brustad et al. | |
| 2018/0206649 | A1 | 6/2018 | Homan et al. | |
| 2022/0257029 | A1 | 8/2022 | Nevins | |

FOREIGN PATENT DOCUMENTS

| | | | |
|---|---|---|---|
| CN | 107669022 | U | 12/2020 |
| CN | 212088923 | U | 12/2020 |
| EP | 2545812 | A1 | 1/2013 |
| ES | 2343215 | | 7/2010 |
| WO | 2008004958 | A1 | 1/2008 |
| WO | 2008004959 | A1 | 1/2008 |
| WO | 079569 | S | 10/2012 |
| WO | 086974 | S | 10/2015 |
| WO | 2016144242 | A1 | 9/2016 |

OTHER PUBLICATIONS

"Bouncer Bliss 3D Jersey", Babybjörn AB, 2022, https://web.archive.org/web/20230124164513/https://www.babybjorn.com/products/baby-bouncers/bouncer-bliss/light-gray-3d-jersey-dark-gray.

"Munchkin Brica XtraGuard Head Support & Strap Cover for Baby Car Seats with Silver-Ion Technology" 1996-2023, Amazon.com, Inc. https://www.amazon.com/Munchkin-XtraGuard-Support-Silver-Ion-Technology/dp/B09SZS5XBK/ ref=sr_1_1?crid=1l4DXQDC14HLV&keywords=munchkin+brica+extra+guard+head+support&qid=1675697523&sprefix=munchkin+Brica+Xtra+%2Caps%2C127&sr=8-1.

"Graco Table2Table Premier Fold 7 in 1 Convertible High Chair | Converts to Dining Booster Seat, Kids Table, and More, Maison" 1996-2023, Amazon.com, Inc. https://www.amazon.com/Graco-Table2Table-Premier-Convertible- Converts/dp/B09MWJ6XH2/ref=sr_1_2?crid=WMV8H1GR54C3&keywords=graco+table2table+premier+fold+7-in-1+convertible+high+chair&qid=1675698010&sprefix=graco+table2table+%2Caps%2C172&sr=8-2.

"Graco DuetSoothe Swing and Rocker", 1996-2023, Amazon.com, Inc. https://www.amazon.com/Graco-DuetSoothe-Swing-Rocker-Winslet/dp/B00AO084CW/ref=sr_1_1?crid=3QLWNUJJ3PT7C&keywords=graco+duetsoothe+swing+%26+rocker&qid=1675698145&sprefix=graco+DUET%2Caps%2C158&sr=8-1.

PCT Patent Application PCT/US2022/041968 International Search Report and Written Opinion dated Dec. 15, 2022.

* cited by examiner

ADJUSTABLE BABY BOUNCER

RELATED APPLICATIONS

This application is a continuation application of U.S. patent application Ser. No. 17/898,719, filed Aug. 30, 2022, entitled "ADJUSTABLE BABY BOUNCER," issued as U.S. Pat. No. 11,576,499 on Feb. 14, 2023 ("the '499 Patent"). The '499 Patent claims priority to U.S. Provisional Patent Application No. 63/292,237, filed Dec. 21, 2021, entitled "ADJUSTABLE BABY BOUNCER." The above patent and application are hereby incorporated by reference in their entirety into the present application

BACKGROUND

1. Field

Embodiments of the present disclosure relate to baby activity devices. More specifically, embodiments of the present disclosure relate to an adjustable bouncer for an infant.

2. Related Art

A baby bouncer is a device that holds an infant and provides them with gentle motion in a manner that can stimulate an infant when they are active, soothe them when they are not, enable an infant to exercise, and enhance free time for parents. A baby bouncer may include a padded seat that cradles an infant and that is retained in a flexible manner on a stand. The seat and stand are dimensioned so that when the baby bouncer is located on a surface, an infant can gently rock while secured in a manner that allows the infant to entertain itself and relax the infant to promote sleep. When the infant moves, the flexible seat gently bounces the infant in accord with the infant's movement. A baby bouncer may include any number of additional features such as rattles, bells, toy bars, and visual stimulators such as lights and mirrors to soothe and/or stimulate the baby.

Most known baby bouncers are not very portable and are thus hard to bring when traveling. Others that are relatively transportable are not particularly easy to use, small in size and/or lightweight. Because of their popularity and because of the desirability to bring them along when traveling, a lightweight baby bouncer that folds into a compact space is highly desirable.

Additionally, prior baby bouncers are not generally adjustable to conform to the child's size, and to adjust with the child as the child grows. Thus, one may need to buy a new bouncer when the child becomes too large for the seat. Prior bouncers are also not designed to securely hold a small infant who may need extra padding and support.

SUMMARY

Embodiments of the present disclosure solve the above-mentioned problems by providing an adjustable, lightweight baby bouncer that may include a removable infant insert conformable to a small infant and including structural features that accommodate growth of the child.

In some aspects, the techniques described herein relate to a baby bouncer, including: a telescopic base for positioning the baby bouncer on a support surface, wherein the telescopic base includes an outer shell portion and an inner extending portion located at least partially within the outer shell portion; an adjustable upper support pivotally coupled to the telescopic base; a connection limb having a first end operatively coupled to the adjustable upper support and a second end operatively coupled to the inner extending portion; an actuation pedal for adjusting an angle of the adjustable upper support in relation to the telescopic base, wherein adjustment of the adjustable upper support causes telescoping of the inner extending portion via the connection limb; a bouncer seat removably coupled to the adjustable upper support including a receiving area and an attachment pocket; an insert for placement in the receiving area and for receiving an infant, the insert including at least one retaining member; and a harness assembly for fastening an infant into the bouncer seat, wherein a portion of the harness assembly is inserted through the at least one retaining member of the insert.

In some aspects, the techniques described herein relate to a baby bouncer, including: a telescopic base for positioning the baby bouncer on a support surface, wherein the telescopic base includes an outer shell portion and an inner extending portion located at least partially within the outer shell portion; an adjustable upper support pivotally coupled to the telescopic base; a connection limb having a first end operatively coupled to the adjustable upper support and a second end operatively coupled to the inner extending portion; an actuation pedal for adjusting an angle of the adjustable upper support in relation to the telescopic base, wherein adjustment of the adjustable upper support causes telescoping of the inner extending portion via the connection limb; a safety lock disposed on the telescopic base, wherein the safety lock prevents inadvertent transitioning of the adjustable upper support to a closed configuration; a bouncer seat removably coupled to the adjustable upper support including a receiving area and an attachment pocket; a removable insert for placement in the receiving area and for receiving an infant including at least one retaining member; and a harness assembly for fastening an infant into the bouncer seat, wherein a portion of the harness assembly is inserted through the at least one retaining member of the removable insert.

In some aspects, the techniques described herein relate to a baby bouncer, including: a telescopic base for positioning the baby bouncer on a support surface, wherein the telescopic base includes an outer shell portion and an inner extending portion located at least partially within the outer shell portion; an adjustable upper support pivotally coupled to the telescopic base; a connection limb having a first end operatively coupled to the adjustable upper support and a second end operatively coupled to the inner extending portion; an actuation pedal for adjusting an angle of the adjustable upper support in relation to the telescopic base, wherein adjustment of the adjustable upper support causes telescoping of the inner extending portion via the connection limb; a bouncer seat removably coupled to the adjustable upper support including a receiving area and an attachment pocket; an insert for placement in the receiving area and for receiving an infant including at least one retaining member, wherein the insert includes a head support for maintaining a head of an infant in a neck neutral position; and a harness assembly for fastening an infant into the bouncer seat, wherein a portion of the harness assembly is inserted through the at least one retaining member of the insert.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

BRIEF DESCRIPTION OF THE DRAWING FIGURES

Embodiments of the present disclosure are described in detail below with reference to the attached drawing figures, wherein.

Figure 1:
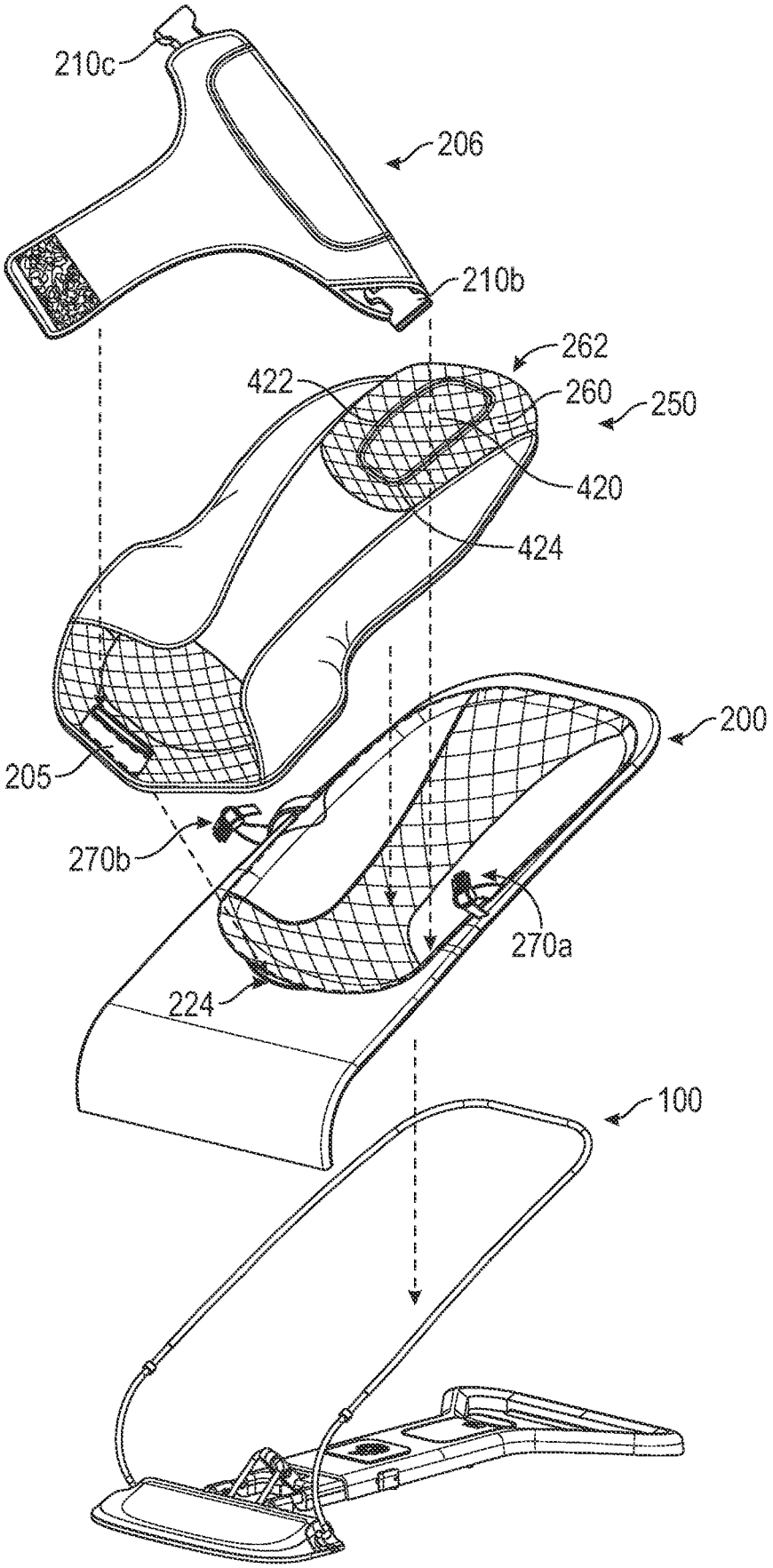
FIG. 1 illustrates an exploded view of a bouncer of embodiments of the present disclosure, including a harness, infant insert, bouncer seat, and frame portion.

The drawing figures do not limit the present disclosure to the specific embodiments disclosed and described herein. The drawings are not necessarily to scale, emphasis instead being placed upon clearly illustrating the principles of the present disclosure.

DETAILED DESCRIPTION

The following detailed description references the accompanying drawings that illustrate specific embodiments in which the present disclosure can be practiced. The embodiments are intended to describe aspects of the present disclosure in sufficient detail to enable those skilled in the art to practice the present disclosure. Other embodiments can be utilized, and changes can be made without departing from the scope of the present disclosure. The following detailed description is, therefore, not to be taken in a limiting sense. The scope of the present disclosure is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Broadly, embodiments of the present disclosure provide for a baby bouncer that provides benefits to both a baby, infant, toddler, or small child (hereinafter infant) and to the parent, guardian, or caregiver (hereinafter, caregiver). Specifically, embodiments of the present disclosure are directed to a baby bouncer comprising multiple parts, components, assemblies, and/or subassemblies that may cooperate to provide multiple advantages to both the infant and the caregiver. Generally, embodiments of the present disclosure provide for a baby bouncer comprising: a frame for providing structural support and a base; a bouncer seat providing a receiving area for accepting an infant and/or an infant insert; an infant insert providing support and stability to an infant; and a harness for securing the infant to the bouncer seat. As described in greater detail below, the infant may be safely restrained while in position in the bouncer seat, allowing the infant to gently bounce for a calming and relaxing effect. As further described below, the caregiver may interact with the frame and bouncer seat for assembly, adjustment, and/or storage.

FIG. 1 is an exploded view depicting various parts of a baby bouncer 10 and an exemplary assembly of baby bouncer 10. In some embodiments, baby bouncer 10 includes a frame 100, a bouncer seat 200, an insert 250, a harness 206, and a harness attachment assembly 500 (see FIGS. 3-4), or any combination thereof. In some embodiments, bouncer seat 200, insert 250, and/or harness 206 may be considered as the "soft goods" portion of baby bouncer 10 and may engage with an infant placed in baby bouncer 10. Starting at a bottom level for engagement with a surface, frame 100 may provide the base or structure of baby bouncer 10. Bouncer seat 200 may be placed on or secured to frame 100 in a manner described herein. In embodiments utilizing an insert 250, insert 250 may be placed in a receiving region 202 of bouncer seat 200. To secure insert 250 and/or an infant to baby bouncer 10, harness 206 may be inserted into an attachment pocket 224 of bouncer seat 200. In embodiments utilizing an insert 250, harness 206 may be inserted through retaining member 205 prior to insertion into attachment pocket 224. It will be appreciated that in further embodiments, optional and/or additional parts or components may be added to baby bouncer 10, which may aid in operability for a caregiver, for entertainment or safety purposes for the infant, or for other purposes.

In some embodiments, bouncer seat 200 may be configured and adapted for receiving both an infant and insert 250, providing caregivers with additional flexibility and options over the prior art. In some embodiments, such a design may be advantageous for increasing the lifespan or usability of baby bouncer 10, providing caregivers with a single baby bouncer 10 that may be used with an infant as the infant grows and develops with age. By way of non-limiting example, a caregiver may utilize a baby bouncer 10 to secure an infant from just a few months old until at least a toddler age by utilizing an insert 250 when the infant is young, and when the infant grows in height and/or weight, transferring the infant from the insert 250 to directly on bouncer seat 200. For example, a baby bouncer 10 with a coupled insert 250 may be adapted for use with infants up to a weight of approximately 20 pounds. Continuing with this example, after the infant reaches a weight of approximately 20 pounds, the insert 250 may be detached or removed from baby bouncer 10 and the infant may be placed and secured directly on to receiving region 202. Receiving region 202 may be adapted for use with infants up to a weight of approximately 30 pounds. However, as described in greater detail below, additional and/or optional inserts or structures may be added to baby bouncer 10 to increase the strength and/or stability of baby bouncer 10 to allow for heavier weights of infants that may be placed and secured on baby bouncer 10.

Bouncer Seat

Figure 2:
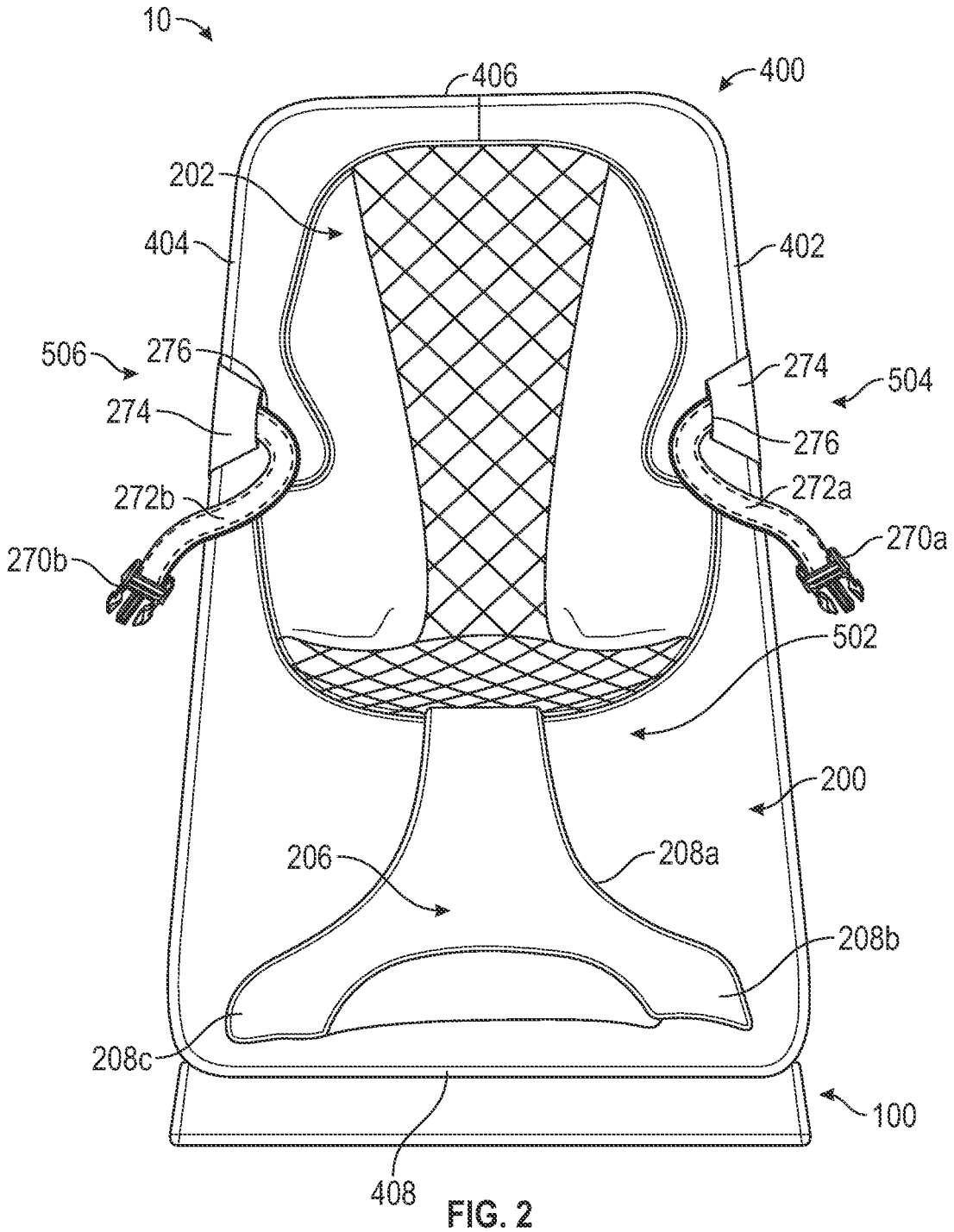
FIG. 2 illustrates a first embodiment of a bouncer seat of a baby bouncer.

Bouncer seat 200 of baby bouncer 10 may generally act as a receiving portion for one or more additional parts or components of baby bouncer 10, including insert 250, and/or for receiving an infant. Generally, bouncer seat 200 comprises a geometric design defined by an outer edgewall 400, comprising a left edgewall 402, a right edgewall 404, a top edgewall 406, and a bottom edgewall 408. Referring to FIG. 2, in some embodiments, bouncer seat 200 may comprise a seat or receiving region (or more simply, "receiving region 202"), which may be adapted and configured for accepting an infant and/or an insert 250, as described in greater detail below. Receiving region 202 may comprise a generally oval-shaped design, similar to that of a seat and adapted for the placement of an infant. However, receiving region 202 may comprise other shapes or designs that are compatible for receiving an infant or insert 250. As described in greater detail below, insert 250 may comprise a generally oval-shaped design similar or identical to the overall shape of receiving region 202.

In some embodiments, bouncer seat 200 may be coupled to or otherwise attached to frame 100. Attachment of bouncer seat 200 to frame 100 may occur via a variety of means and methods. For example, bouncer seat 200 may be removably coupled to frame 100 using mechanical methods and means, such as a mechanical means, such as through hook and loop fasteners, tying, zippers, snap systems, etc. In further embodiments, bouncer seat 200 may be permanently coupled to frame 100 using permanent methods and means of attachment, such as chemical adhering adhesives, or other permanent manners of attachment. Additionally, in some embodiments, a portion, or portions of the frame 100 may be received by a portion or portions of the bouncer seat 200. For instance, a loop or hole may be sewn or otherwise formed into a fabric portion of bouncer seat 200 such that the loop or hole is configured to receive a portion or portions of the frame 100.

Further, in some embodiments, bouncer seat 200 may be adapted and configured to comprise an elastic band (not shown) at an outer perimeter of bouncer seat 200 such that bouncer seat 200 may be wrapped around a portion of frame 100 and an interference fit is created between bouncer seat 200 and frame 100. For example, bouncer seat 200 may comprise one or more openings adapted and configured to allow bouncer seat 200 to wrap around an upper support 110 of frame 100 and be retained in place through an interference fit. Additionally, additional fasteners may be utilized in addition to an interference fit to further secure bouncer seat 200 to upper support 110. However, it will be appreciated that bouncer seat 200 may be attached to frame 100 using any known methods of attachment, and the examples provided herein are intended to be illustrative rather than limiting.

As described in greater detail below and in some embodiments, frame 100 may comprise one or more telescopic arms or limbs for extending a length of at least a portion of frame 100. In further embodiments, baby bouncer 10 may comprise interchangeable frames 100 of varying sizes that may be used with a single bouncer seat 200. Accordingly, in some embodiments, bouncer seat 200 may be configured and adapted for size manipulation, such that a caregiver may increase or decrease the length and/or width of bouncer seat 200. For example, in some embodiments, bouncer seat 200 may comprise an amount of fabric or material that is greater than a maximum length of frame 100, such that at a first length of frame 100, bouncer seat 200 comprises a length that is greater than the length of frame 100. Because of the excess of material of bouncer seat 200 in such an embodiment, the material may need to be accounted for to prevent the excess material from becoming entangled with frame 100 or for causing a tripping hazard to the caregiver. To account for the excess of material, certain implementations may be used. In some embodiments, the excess of material may be folded providing for a decrease of relative length of bouncer seat 200. The excess material that is folded may be folded towards frame 100 or folded underneath a portion of the frame 100, providing a more aesthetically pleasing look to baby bouncer 10; however, it will be appreciated that the excess material could be folded away from frame 100. In some embodiments, the excess material may be held in place via fastening means, such as hook and loop fasteners, buckles, straps, or other mechanical fasteners, providing a caregiver with a method for increasing or decreasing the length of bouncer seat 200 when desired. It will be further appreciated that other methods of dealing with the excess material of bouncer seat 200 may also be employed, and methods such as cinching, bunching, or other suitable methods may be employed.

Infant Insert

As described above, baby bouncer 10 may comprise an insert 250, which may be adapted and configured for removable attachment to the bouncer seat 200. In embodiments, insert 250 may be used with infants of a predetermined weight and/or size to provide additional support, safety, and/or comfort. For example, insert 250 may be utilized by a caregiver to secure an infant to baby bouncer 10 that may not be large enough in weight or size to be placed directly on bouncer seat 200. Accordingly, in some embodiments, insert 250 may be selectively and removably attached to bouncer seat 200, providing a caregiver with the option to remove insert 250 from bouncer seat 200. Methods of such removable attachment are described in greater detail below. As best depicted in FIG. 2, insert 250 may be received by region 202 of bouncer seat 200.

Figure 3:
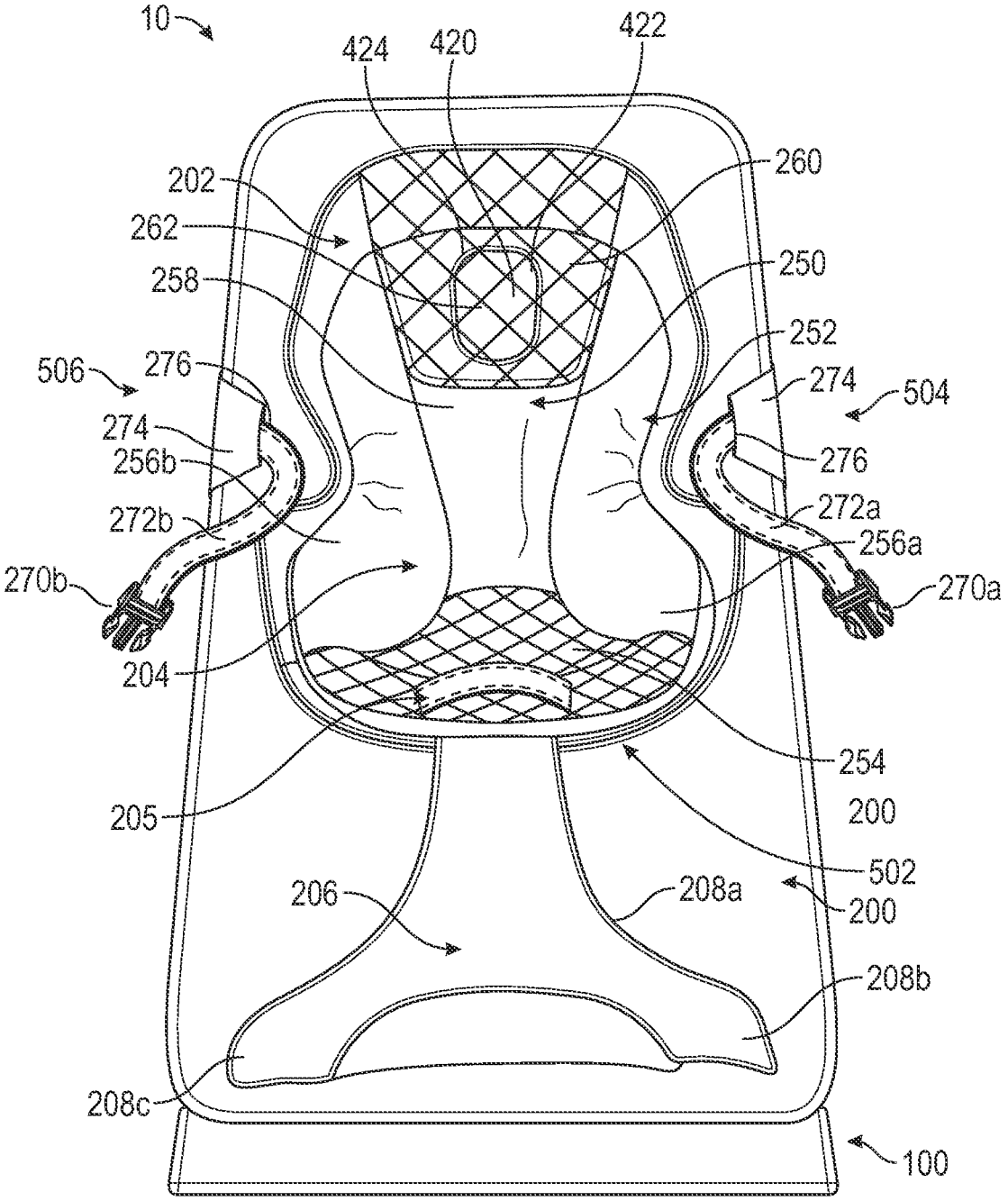
FIG. 3 illustrates the first embodiment of the bouncer seat including an infant insert and harness of the baby bouncer in an open configuration.
Figure 4:
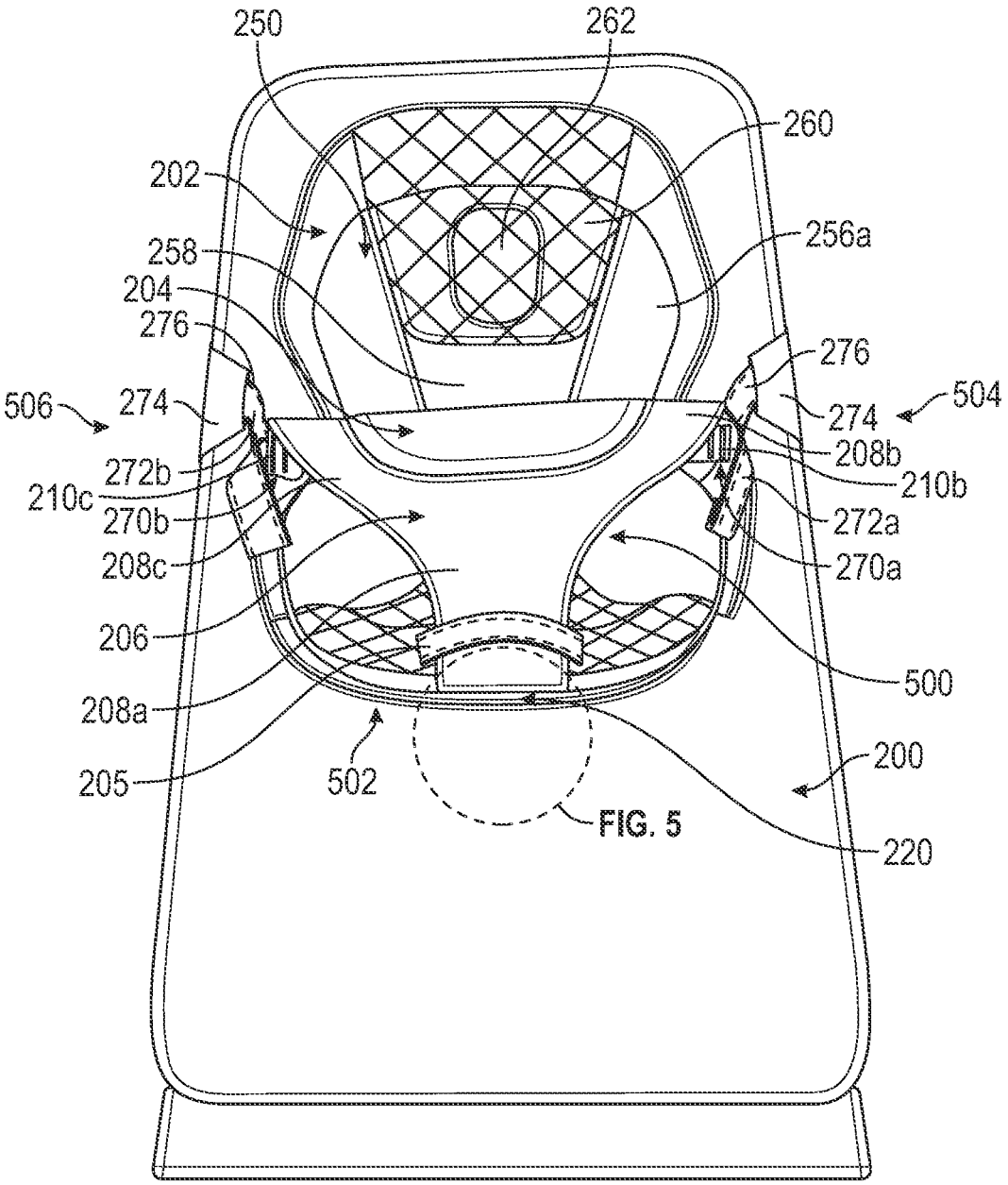
FIG. 4 illustrates the first embodiment of FIG. 3 of a bouncer seat including an infant insert and harness in a closed configuration.

Referring to FIGS. 3-4, insert 250 comprises an insert body 252 providing the structure and shape of insert 250. Insert body 252 may comprise varying designs or profiles, depending on the embodiments, but may generally comprise a design adapted for receiving an infant and/or for fitting within the dimensions of receiving region 202, including for example a generally oval shape or shape that is otherwise compatible with receiving region 202.

In some embodiments, insert body 252 may comprise a lower portion 254, side supports **256*a*, 256*b*, and a back support 258. Lower portion 254 may be adapted and configured as a seat for receiving an infant. Back support 258 may be adapted and configured to provide support to an infant that is placed in insert 250. Like bouncer seat 200, in some embodiments, insert 250 may comprise multiple layers of material. Accordingly, in some embodiments, padding 204 may be placed between two layers of material in insert 250. Padding 204 may be selectively placed at advantageous positions on insert body 252 for the safety and/or comfort of the infant. For example, in some embodiments, padding 204 may be selectively placed at each of side supports 256***a*, 256*b* to provide side support to the infant. Accordingly, side supports 256*a*, 256*b* may be adapted and configured to aid in maintaining the infant in an upright position and preventing the infant from falling to one side. In further embodiments, padding 204 may be selectively placed approximate to lower portion 254 to provide bottom support to the infant. Accordingly, the padding 204 corresponding to lower portion 254 may be configured as a thigh support and aid in elevating the infant's knees, positioning the infant in a more ergonomic position. In even further embodiments, padding 204 may be selectively placed approximate to back support 258 to provide rear support to the infant. It will be appreciated that the padding 204 may be placed in multiple positions of insert body 252, including any combination of the described locations.

In some embodiments, the degree of padding or rigidity provided by padding 204 may vary and may be determined on factors including but not limited to the age of the infant, the weight of the infant, the height of the infant, the location of padding 204 on insert body 252, among other factors. For example, an insert 250 intended for use with a newborn infant may comprise greater rigidity or degree of support than an insert 250 intended for use with a toddler. Further, the degree of rigidity or padding may vary depending on the location of padding 204. For example, more padding or a greater degree of padding may be incorporated in the area corresponding to side supports 256*a*, 256*b* than in the area corresponding to lower portion 254. Even further, in some embodiments, portions of insert body 252 may not comprise padding 204. For example, instead of incorporating padding 204, back support 258 may instead comprise flexibility to provide comfort to the infant. By way of non-limiting example, back support 258 may comprise a mesh-like material, providing breathability, flexibility, and movement of back support 258, and to flex in response to receiving an infant.

Head Receiving Portion of Insert

In some embodiments, insert body 252 may further comprise a head receiving portion 260, which may be adapted and configured for receiving at least a portion of the head of the infant and on which the infant will rest their head. As described above, certain embodiments of insert 250 may be rated or intended for infants of a young age. Accordingly, certain aspects of head receiving portion 260 may vary depending on the embodiment of head receiving portion 260 and/or insert 250 and on factors including but not limited to the age of the infant, the height of the infant, the weight of the infant, among other factors. For example, for toddler aged infants, head receiving portion 260 may comprise padding 204 to provide additional comfort to an infant that is seated in insert 250. In further embodiments, including for example embodiments intended for young infants or infants at a predetermined weight, height, or age threshold, head receiving portion 260 may comprise an indented, recessed, or head hollow 262 portion, adapted and configured for receiving the head of an infant.

In embodiments, the head receiving portion 260 of the insert 250 includes the head hollow 262. Head hollow 262 may be advantageous for maintaining the head and/or neck of the infant in a neutral position thereby protecting the neck of the infant. Young infants have little to no control over their neck, and caregivers must adequately support the head of the infant to prevent injury. The head hollow 262 assists in preventing the infant's head from rocking side-to-side. Accordingly, in some embodiments, head receiving portion 260 may simulate or replicate this action through head hollow 262, such that the infant's head may rest within head hollow 262 and maintain a desired and safe neck and head position.

The head hollow 262 is, in embodiments, a depressed area of the head receiving portion 260 relative to a plane or surface of the head receiving portion 260. As such, the head hollow 262 presents a hollowed, depressed, or otherwise shallowed area in which a rear of the infant's head may rest. In embodiments, the depressed area of head hollow 262 is configured to accommodate the curve of an infant's head. For example, head hollow 262 may be an area of head receiving portion 260 comprising less padding 204 than the remaining portion of head receiving portion 260. In some embodiments, head hollow 262 may comprise no padding, while a remaining portion of head receiving portion 260 does comprise padding 204. Through the interchangeable and customizable design of inserts 250, the degree of padding 204 corresponding to head receiving portion 260 may vary and caregivers may select a degree of padding 204 that is suited for a particular infant. For example, as the infant ages and gains control over the neck, a head receiving portion 260 comprising head hollow 262 may be swapped out for another head receiving portion 260 comprising more cushioned padding 204, or a padded layer (not shown) dimensioned to fit within the head hollow may be removably secured to the head hollow (e.g., via hook and loop fasteners) to provide extra padding. Accordingly, in some embodiments, head receiving portion 260 may be selectively removable. In further embodiments, as the infant ages, the caregiver may select a new insert 250 that comprises a head receiving portion comprising more cushioned padding 204.

In yet further embodiments, head hollow 262 may be formed by a structural depression sewn or manufactured into the insert 250 to thereby create the depressed, hollowed area relative to the plane of the head receiving portion 260. In embodiments, the head hollow 262 may present an interior rear wall 420, a sidewall 422 surrounding the interior rear wall 420, and an edgewall 424 adjacent the surface of the head receiving portion 260. The interior rear wall 420 may present the most depressed area of the head hollow 262, i.e., the area of the head hollow 262 farthest away from the plane of the head receiving portion 260. In embodiments, the sidewall 422 is angled away from the interior rear wall 420 and towards the plane of the head receiving portion 260. The sidewall 422 may gradually blend or otherwise merge with the interior rear wall 420, such that there is not a distinct line of demarcation between the interior rear wall 420 and the sidewall 422. In embodiments, the sidewall 422 surrounds a perimeter of the interior rear wall 420. The edgewall 424 surrounds a perimeter of the sidewall 422 and presents a line of demarcation between the plane of the head receiving portion 260 and the head hollow 262. In embodiments, the transition of materials between the head receiving portion 260, to the edgewall 424, and to the sidewall 422 is relatively smooth so as to provide comfort for the infant. In embodiments, the hollow or depression formed by the head hollow 262 is approximately 5 mm deep relative to the plane of the head receiving portion 260, or approximately 10 mm deep relative to the plane of the head receiving portion 260, or approximately 15 mm deep relative to the plane of the head receiving portion 260, or approximately 20 mm deep relative to the plane of the head receiving portion 260.

Attachment or securement of insert 250 to bouncer seat is discussed below and is effectuated via harness and harness attachment assembly.

Harness

Referring to FIGS. 2-4, in some embodiments, the bouncer seat 200 may further include a harness 206 adapted and configured to (1) securely fasten the infant within receiving region 202 of bouncer seat 200 and/or insert; and/or (2) secure the insert 250 to the bouncer seat. Accordingly, baby bouncer 10 may be adapted and configured to utilize a harness 206 for securing an infant no matter the embodiment.

As illustrated in FIGS. 2-4, harness 206 comprises a lower attachment portion 208*a* and left and right-side attachment arms 208*b*, 208*c*. Each of attachment portion 208*a* and left and right-side attachment arms 208*b*, 208*c* is attached or otherwise secured to the bouncer seat 200 or the insert 250, as discussed in detail below. When the harness 206 is fastened, the infant's legs fit through the openings formed adjacent to the lower attachment portion 208*a* of the harness 206, and the side attachment arms 208*b*, 208*c* would be anchored near the infant's waist, as best illustrated in FIG. 4.

An exemplary embodiment of harness 206 having a curved T-bar configuration is depicted in the Figures, but it should be understood that harness 206 is not limited to a T-bar configuration. For example, one or more shoulder straps, a waist strap, a seatbelt, a chest strap, a double seatbelt, or other harness types may be used in conjunction with, or in replacement of harness 206. It will also be noted that such harnesses may be configured to be readily attached or removed (i.e., detachable) from baby bouncer 10 via a variety of mechanisms. For example, the harness 206 may be attached to bouncer seat 200 or insert 250 via tying, zippers, snaps, buckles, straps, chemical adhesive, sewing together, or any other attachment system. Accordingly, it should be understood that the design, configuration, and/or placement of harness 206 may vary, and is not limited to a "T-bar" configuration or design. For example, in some embodiments, harness 206 may be a three-point, "Y-shaped" safety strap, like a seat belt for a motor vehicles. In further embodiments, harness 206 may comprise a harness configuration, including for example a five-point harness that may be found in racing motor vehicle. However, it will be appreciated that harness 206 may comprise any 2-, 3-, 4-, 5-, and/or 6-point securement device for securing an infant in position.

Harness Attachment Assembly

The attachment of the harness 206 to the bouncer seat 200 and/or insert 250 will now be described. As shown in FIG. 1, the harness 206 is fully separable from the bouncer seat 200 and the insert 250. Because the insert 250 may be selectively used with the bouncer seat 200, the bouncer seat 200 is designed for the harness to be secured directly to the bouncer seat 200 when the insert 250 is not used, or, when the insert is used, to the bouncer seat and the insert 250. The separable harness 206 is distinct from prior art bouncers that do not use an insert 250, where the harness 206 is fixedly secured to the bouncer seat 200, such as the harness 206 being fixedly sewn to the bouncer seat 200 or otherwise integral with the bouncer seat 200. To allow for the harness 206 to be removably secured to the bouncer seat 200 only or to the bouncer seat 200 and the insert 250, embodiments of the present disclosure provide the harness attachment assembly 500. In some embodiments, the harness attachment assembly 500 comprises at least a lower attachment point 502, a left attachment point 504, and a right attachment point 506, a lower harness receiving member 210*a* configured to be removably secured to the lower portion 208*a* of harness 206; left and right side hardness attachment members 210*b*, 210*c* configured to be removably secured to the left and right side attachment arms 208*b*, 208*c* of harness 206; and a retaining member 205. Broadly, lower attachment portion 208*a* (see FIGS. 4-5) of harness 206 is removably secured with lower harness receiving member 210*a*, which at least partially removably couples harness with bouncer seat 200 and/or insert 250. Left and right side attachment arms 208*b*, 208*c* of harness 206 are respectively coupled with left and right side harness attachment members 210*b*, 210*c*, to thereby completely couple harness 206 to bouncer seat 200 and/or insert 250.

Lower Attachment Point of Harness Attachment Assembly

In some embodiments, lower attachment point 502 of harness attachment assembly comprises the lower harness attachment member 210*a* and a bouncer receiving member 220 disposed on the bouncer seat 200. Lower harness attachment member 210*a* may be a fastener disposed on lower attachment portion 208*a* of harness 206. For example, lower harness attachment member 210*a* may be a hook and loop, commonly sold under the trademark VELCRO™. However, it should be understood that lower harness attachment member 210*a* may be any mechanical fastener. Bouncer receiving member 220 may be disposed on the bouncer seat 200 and may comprise a harness fastener 222 for coupling a portion of harness 206 to bouncer seat 200. Harness fastener 222 may be any fastener for mating with harness attachment member 210*a*. For example, in embodiments in which lower harness attachment member 210*a* is a hook and loop fastener, harness fastener 222 may comprise a corresponding hook and loop fastener. In another non-limiting example, lower harness attachment member 210*a* may be the male end of a buckle fastener, and harness fastener 222 may be a female end of a buckle fastener.

Figure 5:
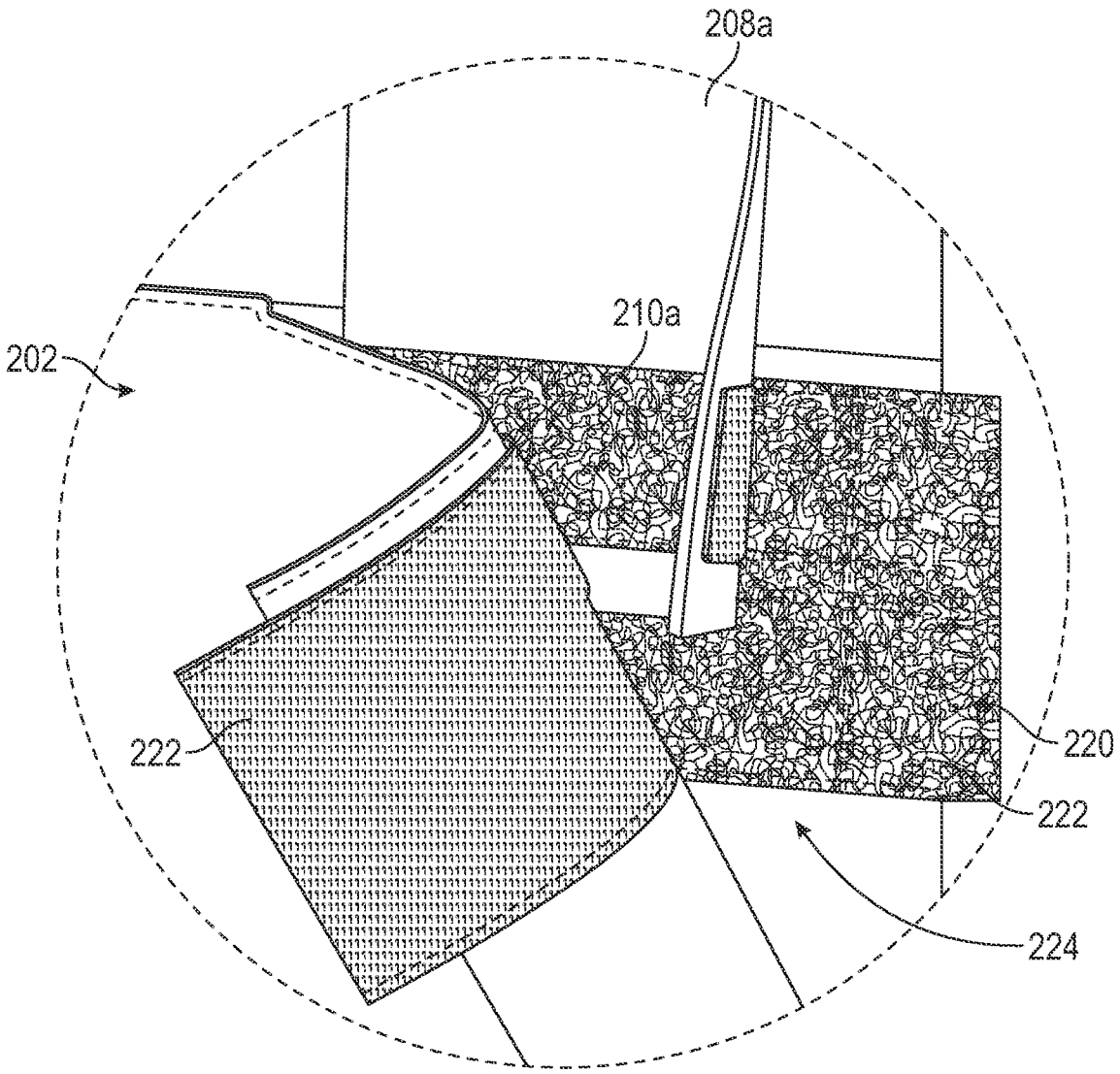
FIG. 5 illustrates an enlarged portion from FIG. 4, namely an exemplary embodiment of an attachment pocket of a baby bouncer.

Referring to FIGS. 4-5, in some embodiments, bouncer receiving member 220 comprises an attachment pocket 224 which may be adapted and configured as a slit, hole, or pocket formed in the bouncer seat 200. FIG. 5 depicts an enlarged view of the phantom portion identified in FIG. 4. Attachment pocket 224 may be adapted and configured for receiving a portion of lower attachment portion 208*a* of harness 206 and for securing harness 206 in position on bouncer seat 200.

As described below, bouncer seat 200 may comprise more than one layer of material, and attachment pocket 224 may be defined between two layers of material of bouncer seat 200. In further embodiments, such as embodiments in which bouncer seat 200 comprises only a single layer of material, attachment pocket 224 may be adapted for placement on an exterior surface of bouncer seat 200. The dimensions of attachment pocket 224 may vary, but generally comprise dimensions for receiving and accepting lower attachment portion 208*a* of harness 206. For example, if lower attachment portion 208*a* comprises a width of 2 inches, then attachment pocket 224 may comprise a width of at least 2.5 inches. Additionally, the depth of attachment pocket 224 may vary, but generally comprises a depth to accept and retain a portion of lower attachment portion 208*a*.

In some embodiments, lower attachment portion 208*a* may be adapted and configured to adjust in length to accommodate infants of varying sizes. Accordingly, attachment pocket 224 may be sized to accommodate an excess amount of lower attachment portion 208*a*. As described in greater detail below, the design of harness 206 may vary depending on the embodiment, and the location and number of attachment pockets 224 may vary to correspond to the design of harness 206. For example, in embodiments in which harness 206 is a 5-point harness, bouncer seat 200 may comprise a plurality of attachment pockets 224 located in positions for receiving the straps or limbs of the 5-point harness.

In some embodiments, attachment pocket 224 may be selectively opened, allowing a caregiver to access an interior of attachment pocket 224, to insert lower attachment portion 208*a* into attachment pocket 224, to secure lower attachment portion 208*a* in place, to remove lower attachment portion 208*a*, to clean attachment pocket 224, among other reasons. Attachment pocket 224 may further comprise the harness fastener 222, which may operatively couple to lower attachment portion 208*a* of harness 206. The fastener may comprise various mechanisms for securing the harness within the attachment pocket 224 or to the bouncer seat 200, such as a zipper, hook and loop fasteners, buttons, snaps, or D-rings. In embodiments, the harness fastener 222 may also serve to retain the pocket in a closed configuration. In the embodiment shown in FIGS. 4-5, the harness fastener 222 is hook and loop that the attachment pocket 224 includes mating hook and loop and the lower portion 208*a* of harness 206 includes one or both of hook and loop (either on one or both sides of the harness 206).

In some embodiments, harness fastener 222 may be located entirely within the dimensions of attachment pocket 224. In further embodiments, at least a portion of harness fastener 222 may be at least partially located outside of the dimensions of attachment pocket 224. Harness fastener 222 may be a compatible fastener or coupling device and may correspond to lower harness receiving member 210*a*. In further embodiments, attachment pocket 224 may comprise a plurality of harness fasteners 222. For example, multiple harness fasteners 222 may be selectively placed in attachment pocket 224 at predetermined intervals, such as at half-inch intervals. A plurality of harness fasteners 222 provides a caregiver with additional options on the location to connect lower portion 208*a* of harness 206 to the bouncer seat 200. For example, to shorten the overall length of harness 206, a caregiver may choose to secure the harness fastener 222 at a distal end of attachment pocket 224, and similarly, to increase the overall length of harness 206, the caregiver may choose to secure the harness fastener 222 at a more proximal end of attachment pocket 224.

Multiple harness fasteners 222 located at a variety of locations provides caregivers with options to find a desired fit for the infant. Further, the multiple harness fasteners 222 may aid in increasing the lifespan of baby bouncer 10, allowing the caregiver to continually use the same baby bouncer 10 as the infant ages. In even further embodiments, harness 206 may be removed entirely from attachment pocket 224 and attachment pocket 224 may be closed or sealed without a harness 206. For example, in some embodiments, baby bouncer 10 may be used with a toddler or an infant that does not require a harness 206. Accordingly, attachment pocket 224 may be closed or sealed and an infant may be placed in receiving region 202 or in insert 250 as described herein without securing the infant via harness 206. In further embodiments, removing harness 206 from attachment pocket 224 may aid in storing baby bouncer 10. In some embodiments, attachment pocket 224 may be closed in a similar manner as when securing a harness 206. For example, attachment pocket 224 may comprise complementary harness fastener 222 that may operably couple together. For example, attachment pocket 224 may comprise complementary hook and loop fasteners that may be used to sandwich the lower portion 208*a* of harness 206 within attachment pocket 224 and be used to close attachment pocket 224 when harness 206 is removed.

Left and Right Side Attachment Points of Harness Attachment Assembly

Harness attachment assembly 500 further comprises a left attachment point 504 and a right attachment point 506 for coupling side attachment arms 208*b*, 208*c* to bouncer seat 200. In some embodiments, left attachment point 504 and right attachment point 506 may be substantially identical in design and configuration. Left attachment point 504 may generally comprise a left side harness attachment member 210*b* and a left side bouncer seat attachment member 270*a*. Right attachment point 506 may generally comprise a right side harness attachment member 210*c* and a right side bouncer seat attachment member 270*b*.

Left side harness attachment member 210*b* may be a fastener located or disposed on side attachment arm 208*b* of harness 206. Likewise, right side harness attachment member 210*c* may be a fastener located or disposed on side attachment arm 208*c* of harness 206. As depicted in FIG. 1, each of left side harness attachment member 210*b* and right side harness attachment member 210*c* may be a female end fastener of a buckle fastener. However, it will be appreciated that any mechanical fastener is contemplated.

Each of bouncer seat attachment members 270*a*, 270*b* may operatively couple to harness attachment members 210*b*, 210*c* for coupling of harness 206 to bouncer seat. Accordingly, bouncer seat attachment members 270*a*, 270*b* may comprise a corresponding fastener to harness attachment members 210*b*, 210*c*. For example, continuing with the depicted embodiment, each of bouncer seat attachment members 270*a*, 270*b* may be male end fastener of a buck fastener. However, as stated above, it will be appreciated that any mechanical fastener is contemplated.

In some embodiments, bouncer seat attachment members 270*a*, 270*b* may be disposed at one end of webbing or straps 272*a*, 272*b* with a second end coupled to bouncer seat 200. For example, the second end of straps 272*a*, 272*b* may couple to the outer edgewall 400 of bouncer seat 200. For example, strap 272*a* may couple at the left edgewall 402 of bouncer seat 200 and strap 272*b* may couple at the right edgewall 404 of bouncer seat 200. In some embodiments, straps 272*a*, 272*b* may be sewn, adhered, molded, mechanically fastened, or coupled to bouncer seat 200 using any known methods of attachment.

Each of straps 272*a*, 272*b* may comprise a tunnel cover 274 at the location that straps 272*a*, 272*b* couple to the bouncer seat 200 for protecting the coupling point. Tunnel cover 274 may be fabric or other material for protecting the coupling point. For example, in embodiments in which straps 272*a*, 272*b* are sewn into bouncer seat 200, tunnel cover 274 may protect the connection point from abrasions or prevent the infant from playing with the connection point. In some embodiments, straps 272*a*, 272*b* may extend out from tunnel cover 274 at a tunnel facing 276, which may be an opening at tunnel cover 274. Additionally, each of straps 272*a*, 272*b* may further comprise an adjustment member for adjusting the length of straps 272*a*, 272*b*. For example, a caregiver may loosen straps 272*a*, 272*b* when initially placing the infant in the baby bouncer 10, and tighten the straps 272*a*, 272*b* after the infant is in position.

Accordingly, harness 206 may be configured to secure a child to insert 250 and/or bouncer seat 200. For example, the lower attachment portion 208*a* of the harness 206 may be received between an infant's legs while the top two outwardly protruding side attachment arms 208*b*, 208*c* of harness 206 may go over the top of the infant's legs. For example, FIG. 4 illustrates an embodiment of baby bouncer 10 in a closed configuration in which the two side attachment arms 208*b*, 208*c* of harness 206 are secured to bouncer seat 200. The two side attachment arms 208*b*, 208*c* of harness 206 may be fastened to straps 272*a*, 272*b* protruding through bouncer seat attachment members 270*a*, 270*b*.

Insert Retaining Members

In some embodiments, bouncer seat 200 and/or insert 250 may optionally and/or additionally comprise at least one retaining member 205 for coupling insert 250 to the harness attachment assembly 500. In some embodiments, retaining member 205 may be a loop disposed on insert 250 for receiving a portion of harness attachment assembly 500 and/or harness 206. For example, attachment retaining member 205 may be a piece of fabric or material fixedly connected at two points on insert 250, with a void space disposed between the two connection points. Retaining member 205 may be constructed from the same material as insert 250 or may be constructed from a different material, including for example the materials provided herein. Depending on the material used to construct retaining member 205, retaining member 205 may be coupled to insert 250 through a variety of attachment methods, including for example, sewing, adhesives, molding, or other attachment methods. Further, the dimensions of retaining member 205 may vary and may be dependent on factors including but not limited to the dimensions of harness 206. For example, as described in greater detail below, one or more portions of harness 206 may be inserted into retaining member 205. Accordingly, retaining member 205 may comprise dimensions large enough to accommodate insertion of a portion of harness 206.

As depicted in FIGS. 3-4, retaining member 205 may be forward positioned and disposed near lower portion 254 of insert 250. To secure insert 250 to bouncer seat 200, lower attachment portion 208*a* of harness 206 may be inserted through retaining member 205 and coupled to bouncer seat 200. After insertion through retaining member 205, lower attachment portion 208*a* of harness 206 may be inserted into attachment pocket 224 and coupled within. Accordingly, through the insertion of lower attachment portion 208*a* into retaining member 205, insert 250 may be coupled to bouncer seat 200.

In some embodiments, coupling through retaining member 205 may provide a floating or sliding effect, wherein insert 250 is secured to bouncer seat 200, but play or movement may still occur, allowing the infant a degree of movement when secured to insert 250. Coupling the insert 250 to bouncer seat 200 using harness 206 and retaining member 205 may provide certain advantages. For example, utilizing a retaining member 205 and harness 206 may eliminate the need for additional attachment points, which may increase the number of potential fail locations as well as add to manufacturing costs. Further, retaining member 205 and harness 206 may also decrease the number of straps or other components that an infant may reach, which could lead to damage to baby bouncer 10 or injury to the infant. As described in greater detail below, the number and/or location of retaining member 205 may vary and may be dependent on the design of harness 206.

Materials for Manufacturing the Soft Goods

In some embodiments, each of bouncer seat 200, insert 250, and harness 206, or any combination thereof, may be constructed or manufactured from a flexible material adapted to contour and adapt to different sizes, shapes, and configurations of frame 100. For example, in some embodiments, bouncer seat 200, insert 250, and/or harness 206 may be constructed from fabric such as polyester, cotton, wool, nylon, denim, velvet, fleece, chiffon, flannel, leather, synthetic, etc., providing for a flexible material to contour to the shape and size of frame 100. Optionally or additionally, the material for bouncer seat 200, insert 250, and/or harness may be a hypoallergenic, breathable, soft, felted, or any other suitable material for placing an infant for an extended time period. Even further, each of bouncer seat 200, insert 250, and harness 206 may be constructed from a plurality of layers of material. The plurality of layers of material may be advantageous for the insertion of padding 204 and/or for manufacturing attachment pocket 224.

As described in greater detail below, in some embodiments, frame 100 may comprise one or more telescopic limbs, allowing for parts of frame 100 to become shorter or longer. In some embodiments, it may be advantageous for a single bouncer seat 200 to be used with any frame 100, providing caregivers a means to increase the size of baby bouncer 10 as the infant ages and grows. Accordingly, in some embodiments, bouncer seat 200 may be adjustable in size, adjusting to dimension changes in frame 100. In further embodiments, bouncer seat 200 may not be adjustable in size and instead, may comprise a set or otherwise permanent height, width, length, or other dimensions.

Additionally, the bouncer seat 20, the insert 250, and/or the harness 206 may be manufactured or constructed from a variety of materials including a combination of materials that are selectively positioned. In some embodiments, the material(s) used to construct the bouncer seat 200 and/or the insert 250 may comprise varying patterns, inserts, or other designs to provide additional comfort to the infant, to aid in clean up, among other purposes. For example, the material corresponding to the head receiving portion 260 and/or lower portion 254 may comprise a quilting or otherwise cross-stitched design having a plurality of connected geometric shapes. The quilting design may aid in engaging the bouncer seat 200 and/or the insert 250 with the infant. It should be understood that bouncer seat 200 and/or insert 250 may comprise patterning or designs at multiple locations, in addition to or instead of at head receiving portion 260 and lower portion 254. It should be further understood that the design of the patterning may vary depending on location, and bouncer seat 200 and/or insert 250 may comprise a plurality of patterns corresponding to a plurality of locations.

Exemplary Embodiments and Optional or Additional Features

As described above, harness 206 may comprise a variety of shapes, configurations, and/or designs depending on the embodiment, including but not limited to 3-point straps, 4-point harnesses, and/or 5-point harnesses. As further described above, insert 250 may comprise retaining member (i.e., retaining member 205, retaining member 364, retaining member 366*a*, retaining member 366*b*) for the insertion of a portion of harness 206 or straps 272*a*, 272*b* which may aid in securing insert 250 into position within the receiving region 202 of bouncer seat 200. In some embodiments, insert 250 may comprise a plurality of attachment retaining members 205, which may aid in coupling insert 250 to bouncer seat 200. Accordingly, in some embodiments, the number and placement of retaining members on insert 250 may be based at least in part on the design, shape, and/or configuration of harness 206. For example, in embodiments in which harness 206 is a 5-point harness, insert 250 may comprise five retaining member disposed or located on insert 250 at locations approximate to each strap of the 5-point harness. As described above, each strap or portion of the 5-point harness may be inserted into each of the five retaining members, thereby securely coupling insert 250 in position. It should be understood that in some embodiments, the number of retaining members may not correspond directly to the number of straps of a multiple point harness. For example, continuing with the 5-point harness example, insert 250 may comprise fewer than five retaining members, and only a portion of the straps of the 5-point harness may be inserted into a retaining member.

In some embodiments, bouncer seat 200 may be adapted and configured for receiving one size of insert 250. In further embodiments, a single bouncer seat 200 may couple to a plurality of inserts 250 having a variety of different sizes. For example, one bouncer seat 200 may be configured to mechanically attach to two, three, four, five, or more separate interchangeable inserts 250. Continuing with this example, the separate and interchangeable inserts 250 may comprise varying sizes, padding, weight ratings, or other features. For example, the separate and interchangeable inserts 250 may be adapted and configured for use with infants having a range of predetermined weights and heights, which may correspond to governmental standards or regulations, or other safety requirements or standards. Accordingly, as an infant ages and increases in weight and height, the infant may size out of certain embodiments, sizes, or designs of inserts 250. In response, a caregiver may exchange one insert 250 with another separate and interchangeable insert 250 when the infant sizes out of the first insert 250.

In further embodiments, inserts 250 may be adapted and configured with different levels of padding or different configurations, to provide caregivers with options of selecting an insert 250 that is compatible with the infant. Accordingly, in addition to selecting an insert 250 based on size, a caregiver may also select an insert based on the preference of the infant. Such adjustability may allow for one bouncer seat 200 to accommodate differently sized infants by simply changing out the insert 250. Additionally, multiple inserts 250 may be provided such that an insert 250 may be replaced when another insert 250 needs to be cleaned or to provide different patterns for aesthetic features. It should be further understood that insert 250 may be used with other baby seats or other similar structures, including but not limited to highchairs, strollers, sleepers, or other devices or structures for use with infants, toddlers, or children. For example, insert 250 may be adapted for use with a stroller, providing ergonomic support and/or comfort to an infant during a stroller ride.

In even further embodiments, insert 250 may optionally and/or additionally comprise one or more void spaces (not shown) or other openings. In some embodiments, portions of harness 206 or straps 272*a*, 272*b* may enter through the one or more void spaces before coupling, thereby securing insert 250 to bouncer seat 200. For example, retaining member 205 may be replaced with a void space or other opening in insert 250, wherein lower attachment portion 208*a* may enter the void space prior to insertion into attachment pocket 224. By way of another non-limiting example, in embodiments in which harness 206 is a 5-point harness, insert 250 may comprise void spaces defined in back support 258 that the straps of the 5-point harness may be inserted through for securing insert 250 in position on bouncer seat 200.

As described above, and in some embodiments, an infant may be placed within receiving region 202 of bouncer seat 200 without the use of insert 250. For example, as the infant ages, the infant may grow too large for placement in insert 250. Accordingly, receiving region 202 may comprise padding 204 arranged and configured in the manner described above with respect to insert 250 and/or insert 350. For example, in some embodiments, bouncer seat 200 may comprise padding 204 arranged in a corresponding manner to insert 250 and/or 350 as described above, and comprise a seat portion, side supports, a back support, a head receiving portion, or any combination thereof. Accordingly, in some embodiments, a single baby bouncer 10 may be used with an infant as the infant ages and grows.

Alternative Infant Insert Embodiment

Figure 6:
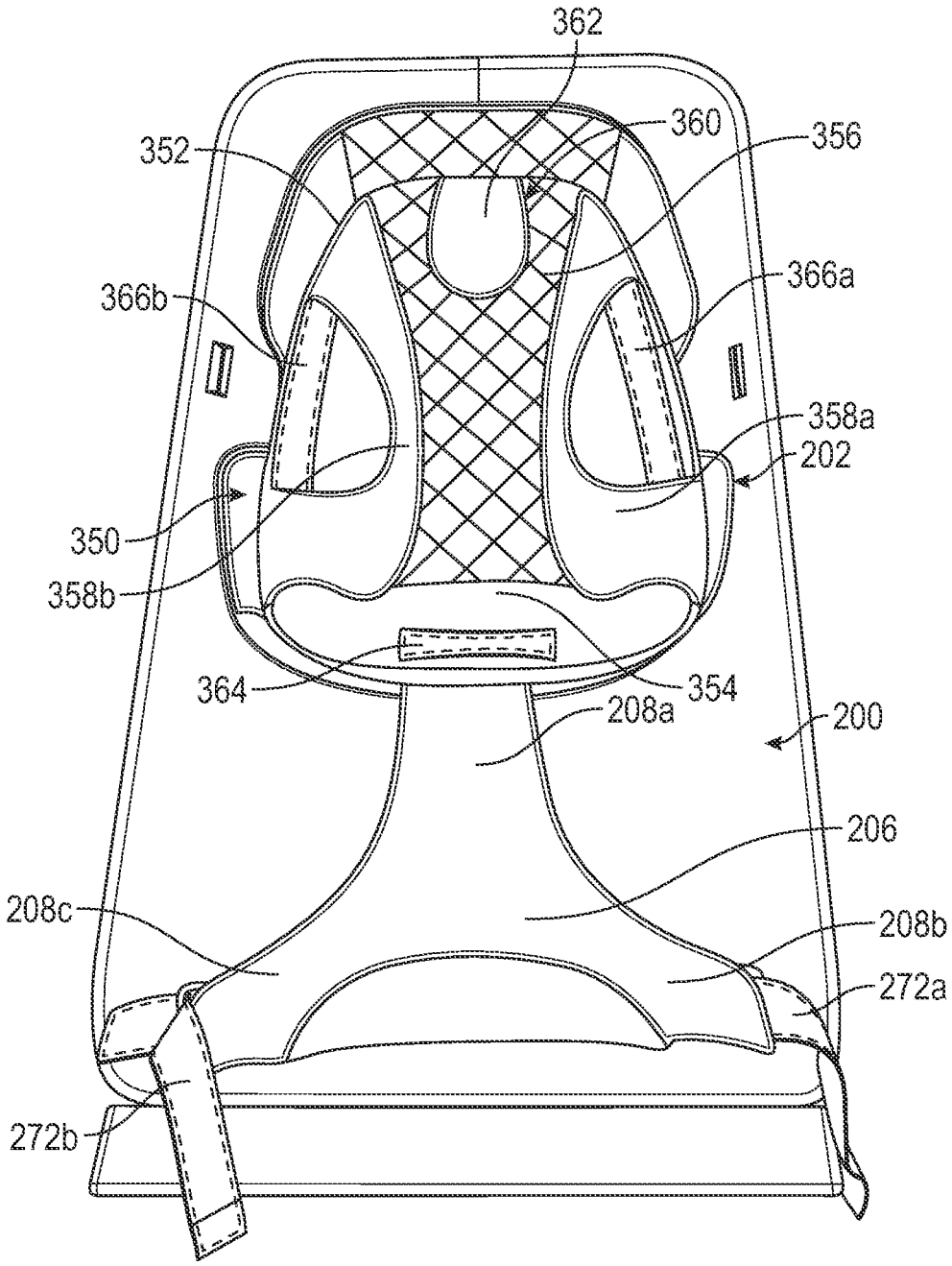
FIG. 6 illustrates a second embodiment of an infant insert and harness of the baby bouncer in an open configuration.

FIG. 6 illustrates a second exemplary embodiment of infant insert 350. In some embodiments, infant insert 350 may generally correspond to the overall design of infant insert 250, with some modifications. For example, infant insert 350 may comprise an insert body 352 having an ergonomic substantially rounded triangular shape. Insert body 352 may comprise a seat portion 354, a back support 356, side supports 358*a*, 358*b*, and head receiving portion 360. Like head receiving portion 260, head receiving portion 360 may include padding 204 with a head hollow 362 for receiving the head of the infant. Side supports 358*a*, 358*b* may include extra padding 204 for cushioning the infant and for securely holding the infant therein. Additionally, in some embodiments, the insert 350 may include ridges or indentations for providing breathability. For example, back support 356 may comprise padding 204 configured with ridges or indentations. Seat portion 354 may include padding 204 for providing cushion to the infant and for positioning the infant in an ergonomic position.

In some embodiments, insert body 352 may further include a retaining member 364 for receiving the harness 206 therethrough. In some embodiments, retaining member 364 may be disposed adjacent to seat portion 354. As described above with respect to insert 250, retaining member 364 may aid in maintaining or keeping alignment of harness 206. In further embodiments, retaining member 364 may aid in maintaining a tighter hold against the infant placed in insert 350. In some embodiments, each side supports 358*a*, 358*b* may further comprise retaining members 366*a*, 366*b*. In some embodiments, straps 272*a*, 272*b* and/or side attachment arms 208*b*, 208*c* may be inserted through retaining members 366*a*, 366*b* of side supports 358*a*, 358*b* prior to attaching to bouncer seat attachment members 270*a*, 270*b*. Accordingly, retaining members 366*a*, 366*b* may aid in alignment of harness 206 and/or for providing a tighter fit against the infant. Additionally, retaining members 366*a*, 366*b* may aid in keeping straps 272*a*, 272*b* or portions of harness 206 away from the infant, preventing the infant from grabbing or playing with straps 272*a*, 272*b* or harness 206.

Hard Goods

As described above, the frame 100 of baby bouncer 10 may be considered the "hard goods" portion, providing the structure to baby bouncer 10 and for receiving the soft goods. FIGS. 7-13 illustrate different views and aspects of the frame 100 and are best viewed together for the following description. Generally, the frame 100 comprises a telescopic base, an upper support 110, and an actuation mechanism 600.

Telescopic Base

As best illustrated in FIGS. 7-10 and in some embodiments, frame 100 includes an extendable telescopic base 150. The telescopic base 150 may be the portion of the baby bouncer 10 that engages with the ground, floor, or other substrate. The shape and design of telescopic base 150 may vary, and in some embodiments, comprise a telescopic shelled design. In some embodiments, telescopic base 150 may comprise a generally elongated design, providing for surface area for contact with the floor and/or for providing stability in maintaining upper support 110 and/or bouncer seat 200 in an upright and desired position. Generally, the telescopic base 150 comprises a distal end 152, a proximal end 154, and an extendable member 156 disposed therebetween.

The overall length of telescopic base 150 may vary, depending on the embodiments, and may be dependent on factors including but not limited to the length of upper support 110, the width of telescopic base 150, the weight of the infant intended for use with baby bouncer 10, among other factors. By way of non-limiting example, telescopic base 150 may comprise a length of about 24 inches to about 36 inches. Additionally, the width of telescopic base 150 may likewise vary and may be dependent on factors including but not limited to the length of upper support 110, the length of telescopic base 150, the weight of the infant intended for use with baby bouncer 10, among other factors. As described in greater detail below, at least a portion of telescopic base 150 may comprise a telescopic design adapted and configured for selectively telescoping of a portion of telescopic base. Accordingly, the geometric shape of telescopic base 150 should generally comprise a shape adapted for telescopic movement, including but not limited to a rectangular or circular tube design.

Figure 8:
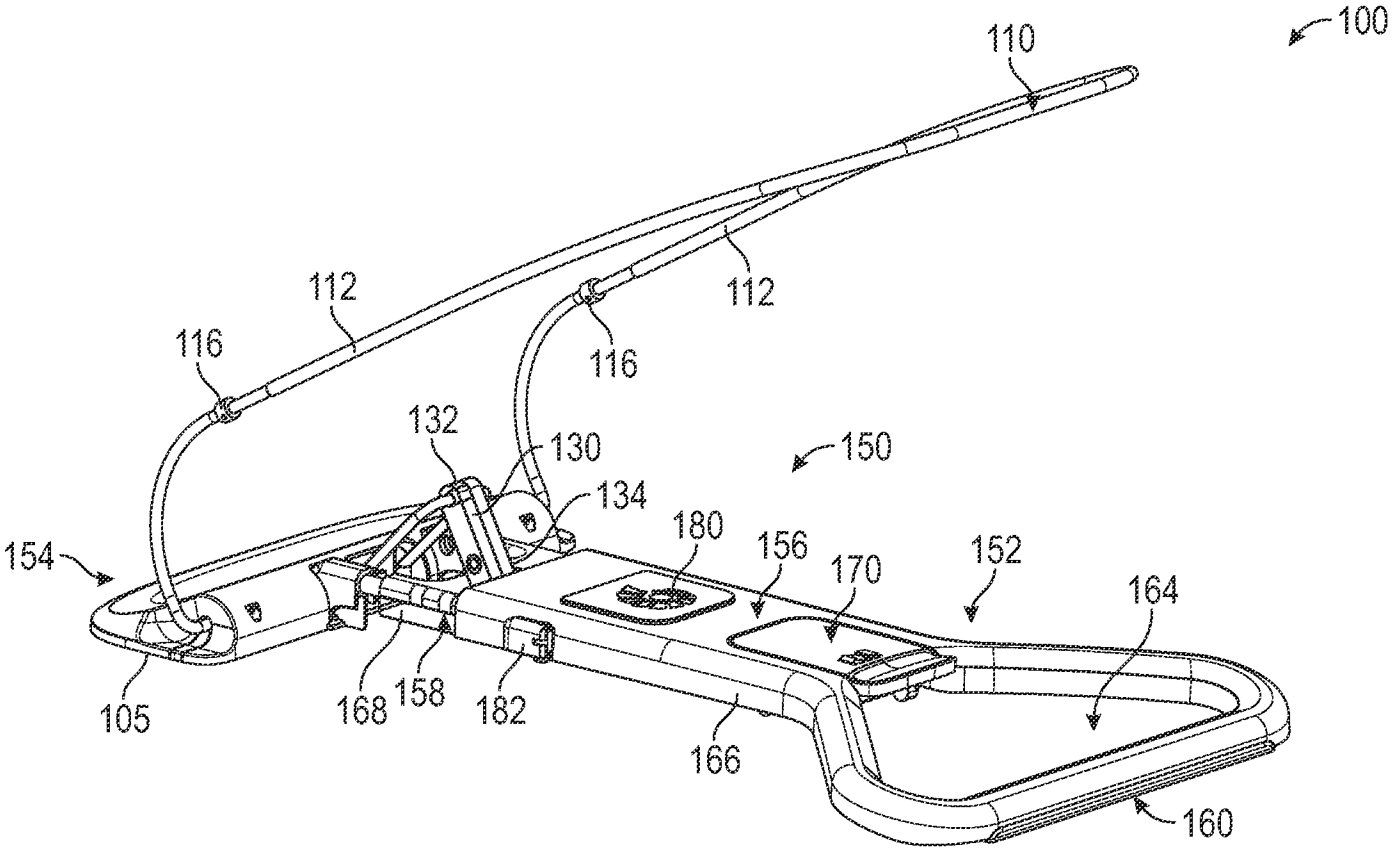
FIG. 8 illustrates a back perspective view of the frame, in some embodiments.
Figure 9:
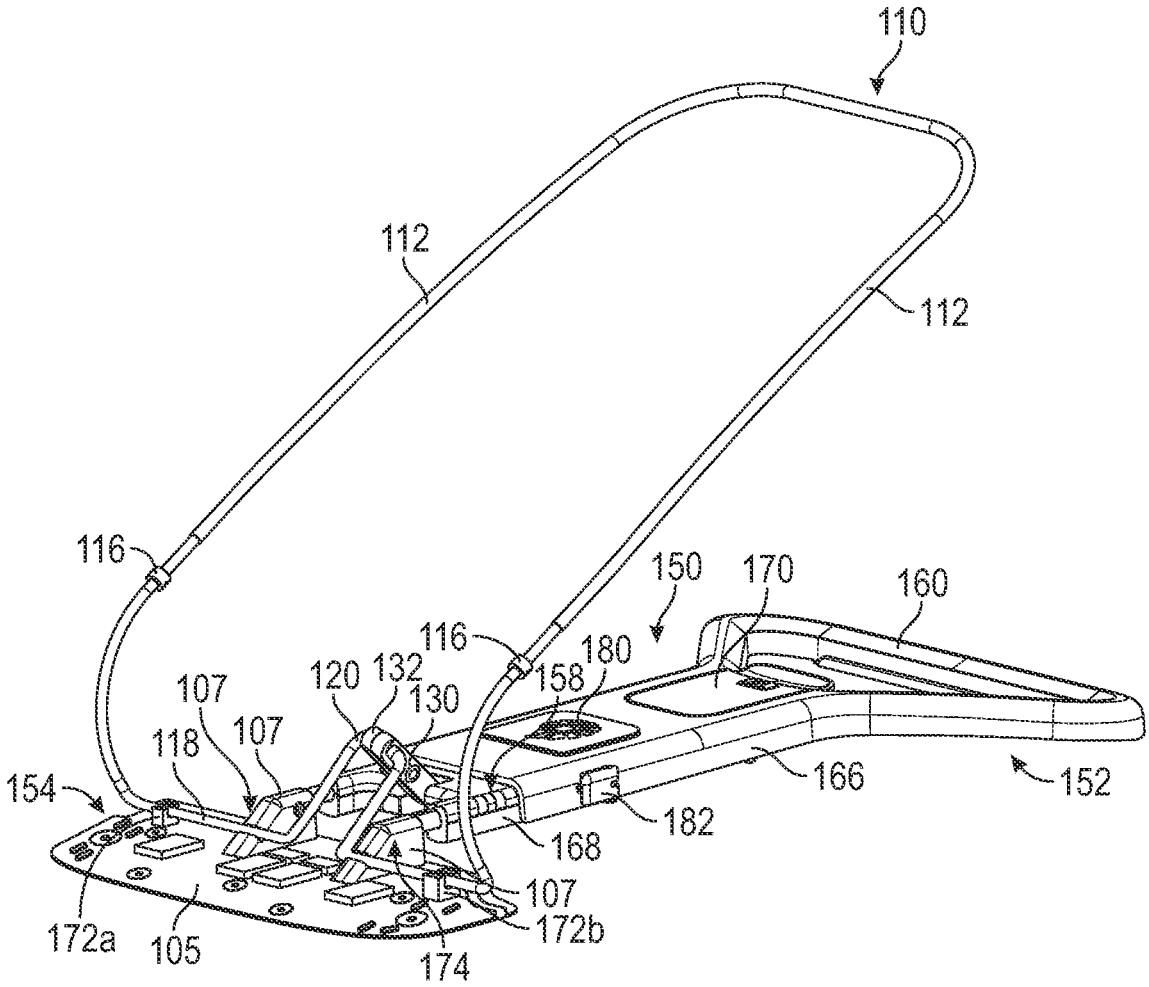
FIG. 9 illustrates the frame and the internal structure of a connector portion, in some embodiments.
Figure 10:
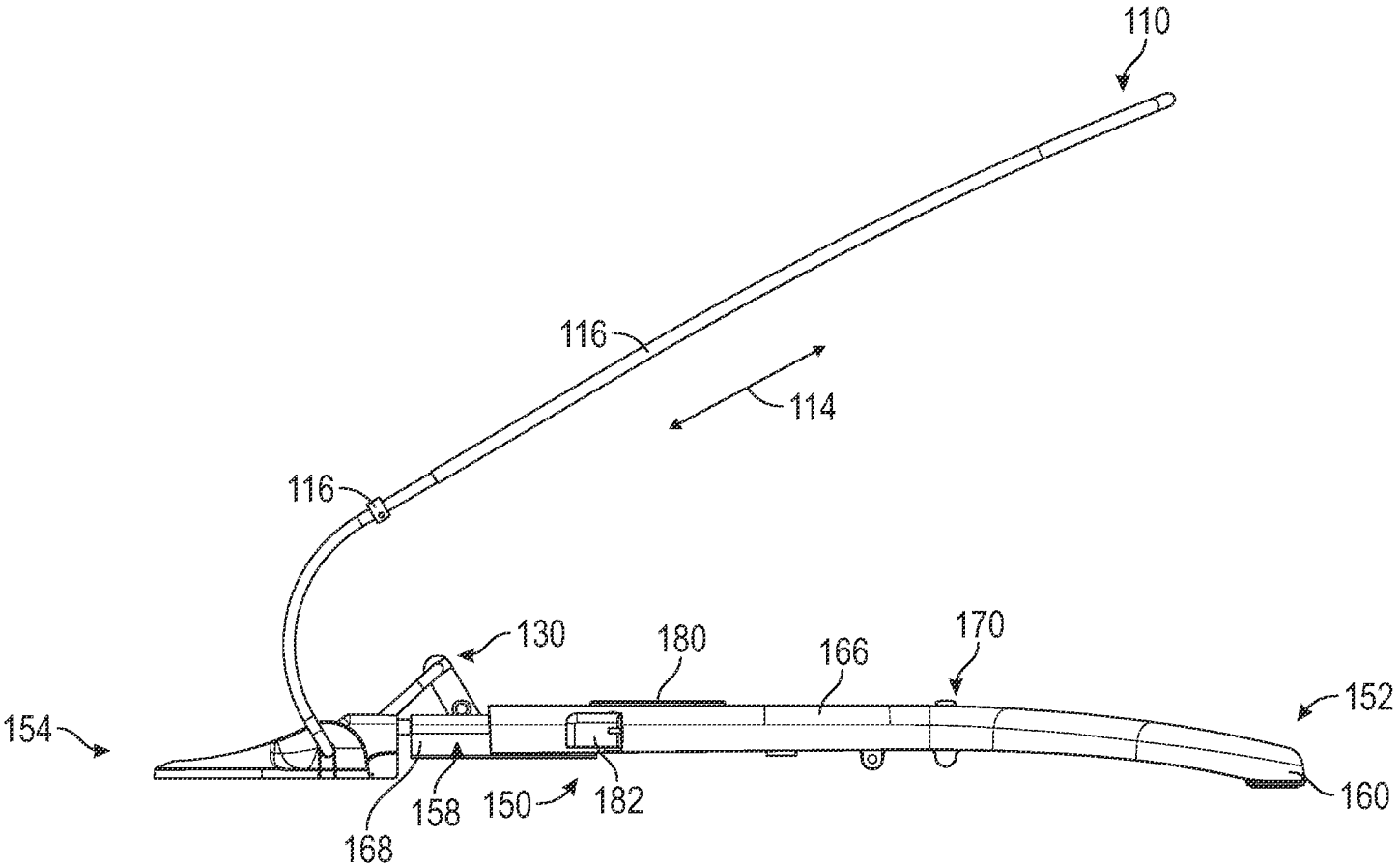
FIG. 10 illustrates a side view of the frame, in some embodiments.
Figure 11A:
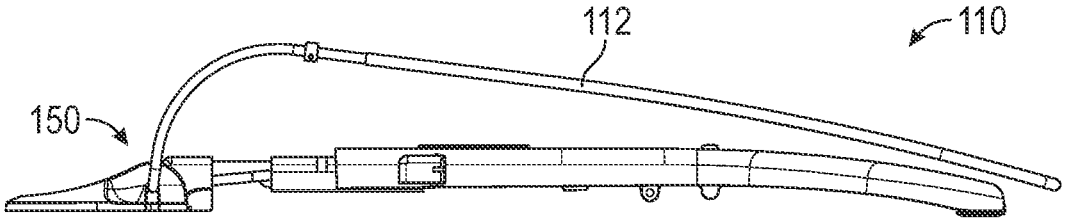
FIGS. 11A-11D illustrate different configurations of a support of the frame, in some embodiments.
Figure 11B:
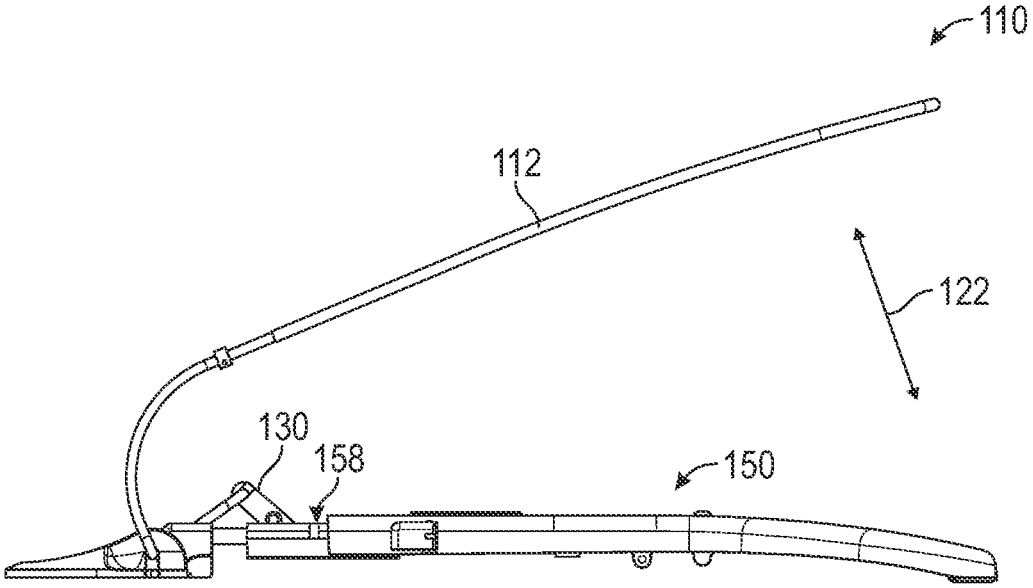
Figure 11C:
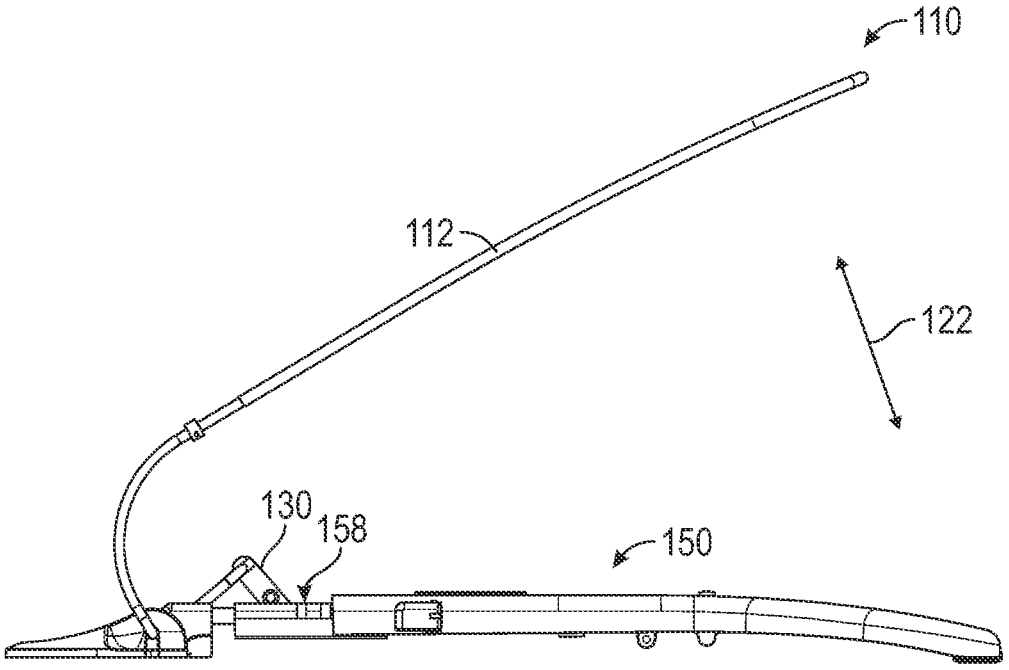
Figure 11D:
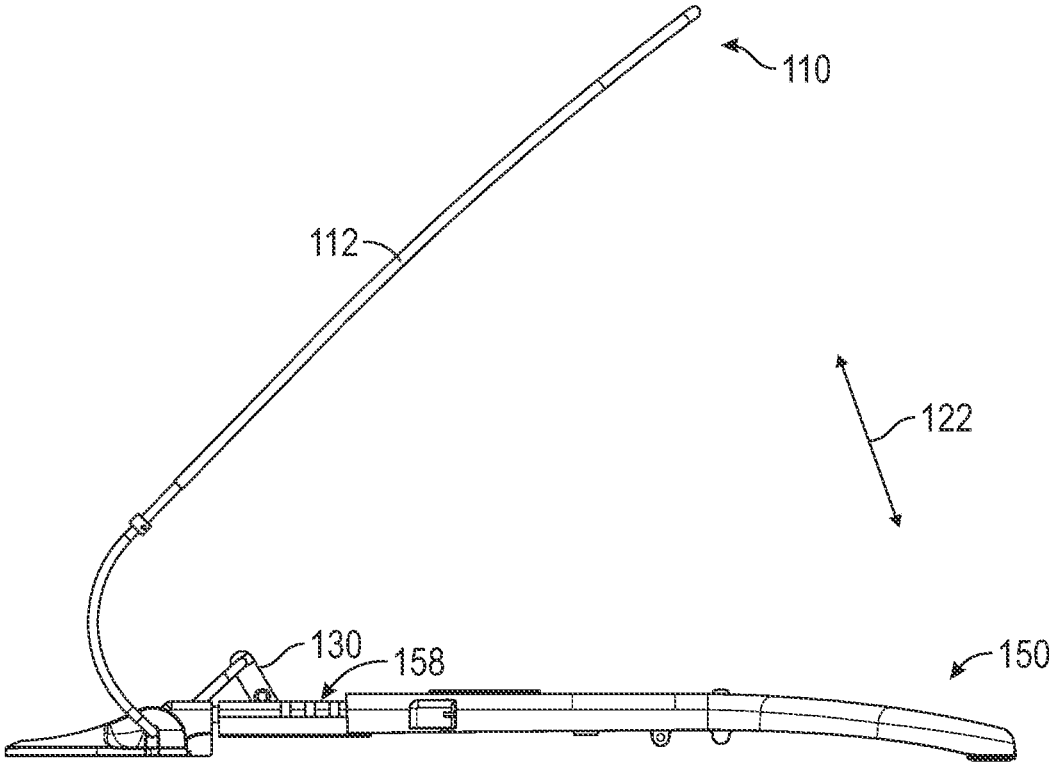

As best depicted in FIGS. 8-10, telescopic base 150 may comprise a distal end 152, a proximal end 154, and an extendable member 156 disposed therebetween. Turning to FIG. 8, distal end 152 may be configured or comprise an anchor portion 160, which may aid in providing stability to baby bouncer 10, particularly when an infant has been placed in the bouncer. As depicted, anchor portion 160 may comprise a bulbous, bell-end, or curved shape, which may comprise a greater width than the width of extendable member 156. However, it will be appreciated that anchor portion 160 may comprise any geometric shape that may provide stability to frame telescopic base 150 and/or frame 100. As further depicted, in some embodiments, anchor portion 160 may comprise an open portion or void space 164 (see FIG. 8). As described in greater detail below, telescopic base 150 be operatively coupled to the actuation pedal 170 of the actuation mechanism 600 for actuating the extendable member 156. In some embodiments, void space 164 aids in providing a caregiver with access to the actuation pedal 170. Void space 164 may be located entirely within the dimensions of anchor portion 160, such that an outer perimeter of anchor portion 160 is solid and devoid of any gaps or space. Accordingly, the structural integrity of anchor portion 160 may remain intact, while also providing a caregiver the advantage of accessing actuation pedal 170.

Moving proximally from distal end 152, telescopic base 150 further comprises the extendable member 156. In some embodiments, extendable member 156 may comprise an outer shell portion 166 and an inner extending portion 168 (see FIG. 8) providing for the telescoping of telescopic base 150, in which outer shell portion 166 may at least partially surround and house inner extending portion 168. Upon actuation, inner extending portion 168 may selectively telescope into or away from outer shell portion 166. In some embodiments, inner extending portion 168 may be guided though a rail structure (such as connecting members 300*a*, 300*b* as described below), guiding shelves, or other structure providing for a cooperative fit between outer shell portion 166 and inner extending portion 168, providing for both coupling and transversal movement of inner extending portion 168. Accordingly, inner extending portion 168 may selectively extend or withdraw in position from outer shell portion 166.

As further depicted in FIGS. 7-10, and in some embodiments, inner extending portion 168 may comprise one or more visual indicators 158. Visual indicators 158 may be markings, etchings, symbols, or other visual indicators for providing a visual indication to the caregiver during actuation when a pre-determined position of upper support 110 and/or inner extending portion 168 has been reached or may about to be reached. For example, visual indicators 158 may be recessed etchings defined on inner extending portion 168. In further embodiments, visual indicators 158 may be colored lines or symbols. However, it will be appreciated that the design of visual indicators 158 may comprise any design that conveys to a caregiver that an actuation position is about to be reached or has been reached.

As described in greater detail below, actuation of actuation pedal 170 selectively changes the angle of upper support 110 and or the length of extendable member 156. Rather than relying solely on a tactile response, visual indicators 158 may provide a caregiver with a visual indication when a locking position is reached or may be about to be reached. The number of visual indicators 158 may vary and the number of visual indicators may be dependent on the number of angles that upper support 110 may be locked in at, and/or the length that extendable member 156 may be locked at. For example, in embodiments in which upper support 110 may be adjustable and locked at four different angles, inner extending portion 168 may comprise four visual indicators 158. However, it will be appreciated that the number of visual indicators 158 may vary and may not necessarily correspond to the number of angles of upper support 110. For example, at a closed position, a visual indicator 158 may not be necessary to alert a caregiver that upper support 110 is in a closed position.

Figure 7:
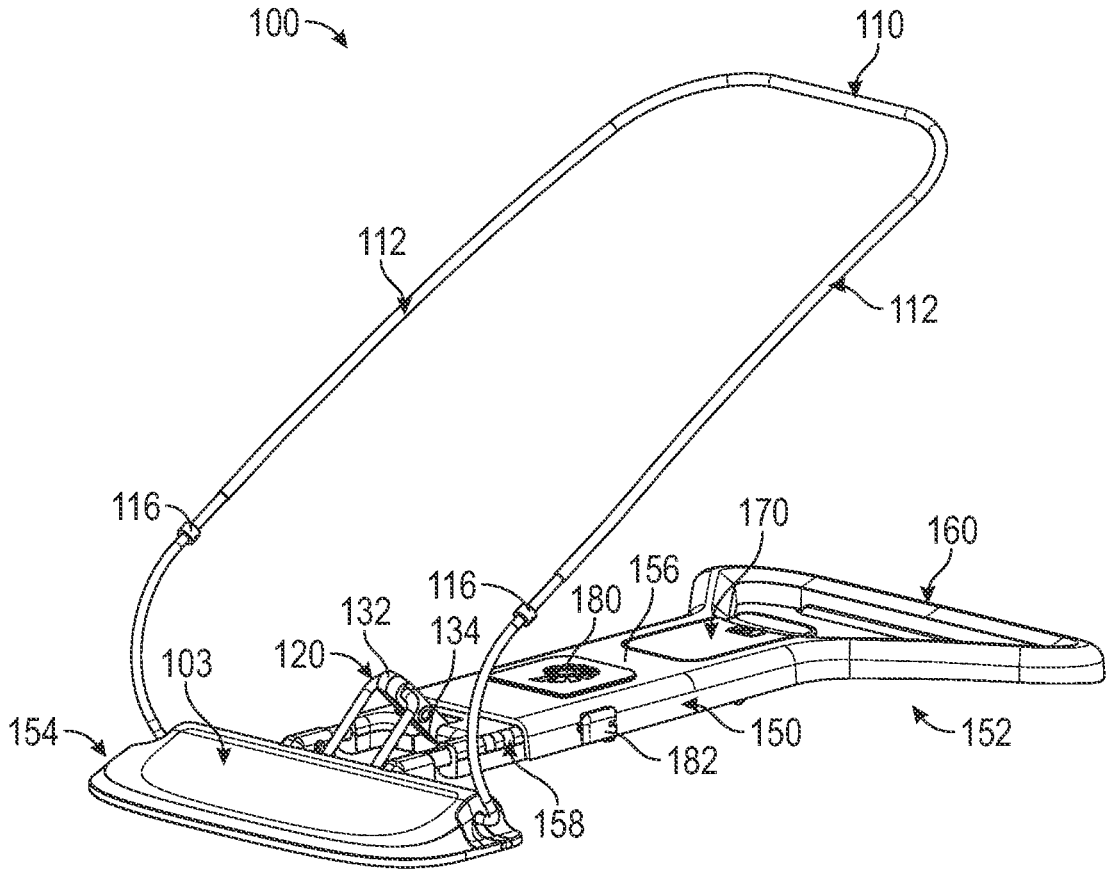
FIG. 7 illustrates a front perspective view of the frame of a baby bouncer with the seat removed, in some embodiments.

Continuing in a proximal direction and as best depicted in FIG. 7, telescopic base 150 may further comprise a proximal end 154. In some embodiments, proximal end 154 may comprise a cover plate 103 and a base plate 105. Cover plate 103 may enclose certain aspects of the frame 100, such as connecting structures located on base plate 105 for coupling telescopic base 150 to upper support 110. For example, base plate 105 may comprise rotatable connectors 172*a*, 172*b* and stabilizing connectors 107 for, among other purposes, providing a pivotable attachment location for upper support 110.

Additionally, cover plate 103 may provide frame 100, telescopic base 150, and/or baby bouncer 10 with an aesthetic look. In some embodiments, cover plate 103 may be domed or otherwise comprise a complementary shape to cover one or more inner parts or components of telescopic base 150. Base plate 105 may provide surface area for engaging with the ground or floor. Accordingly, base plate 105 may work in conjunction with anchor portion 160 to provide stability and rigidity to telescopic base 150. The design and shape of base plate 105 may vary but may generally comprise a planar design to aid in maintaining frame 100 in a level position.

Proximal end 154 and outer shell portion 166 may be separated by a gap 380 having a predetermined distance. In some embodiments, gap 380 may be the space or area for inner extending portion 168 to enter when telescoping out of outer shell portion 166. Accordingly, gap 380 may be large enough for inner extending portion 168 to transverse. For example, gap 380 may be about 4 inches in length to about 12 inches in length.

In some embodiments, proximal end 154 may be coupled or otherwise connected to extendable member 156 through one or more base connection supports. As depicted in the FIG. 13, proximal end 154 and extendable member 156 may be connected through two base connection supports 300*a*, 300*b*. In some embodiments, base connection supports may be tubing or rigid rods along which inner extending portion 168 may slide. Connection supports 300*a*, 300*b* may be at least partially located within the interior of outer shell portion 166 and extend out from outer shell portion 166 and connect to proximal end 154. As described herein and in some embodiments, inner extending portion 168 may telescope into and out of outer shell portion 166 during adjustment of the height of upper support 110. Accordingly, inner extending portion 168 may comprise a channel or opening defined through the length of inner extending portion 168, which connection supports 300*a*, 300*b* may be inserted into. Through such a design, inner extending portion 168 may transverse across a gap or space between proximal end 154 and outer shell portion 166.

Each of connection supports 300*a*, 300*b* may be coupled to proximal end 154 and extendable member 156 through known means of attachment, including but not limited to mechanical fasteners such as screws, molding, adhesives, among other fasteners. For example, in some embodiments, connection supports 300*a*, 300*b* may be attached to rotatable connectors 172*a*, 172*b* through an adhesive and may further be attached to outer shell portion 166 through a plurality of screw fasteners. Further, the length of connection supports 300*a*, 300*b* may vary, but generally comprise a length sufficient to cross gap 380 and couple to each of proximal end 154 and outer shell portion 166. In some embodiments, connection supports 300*a*, 300*b* may extend a distance into outer shell portion 166. For example, connection supports 300*a*, 300*b* may extend approximately the length of outer shell portion 166 until reaching anchor portion 160. In some embodiments, connection supports 300*a*, 300*b* may extend into anchor portion 160 and may be coupled to anchor portion 160.

Figure 13:
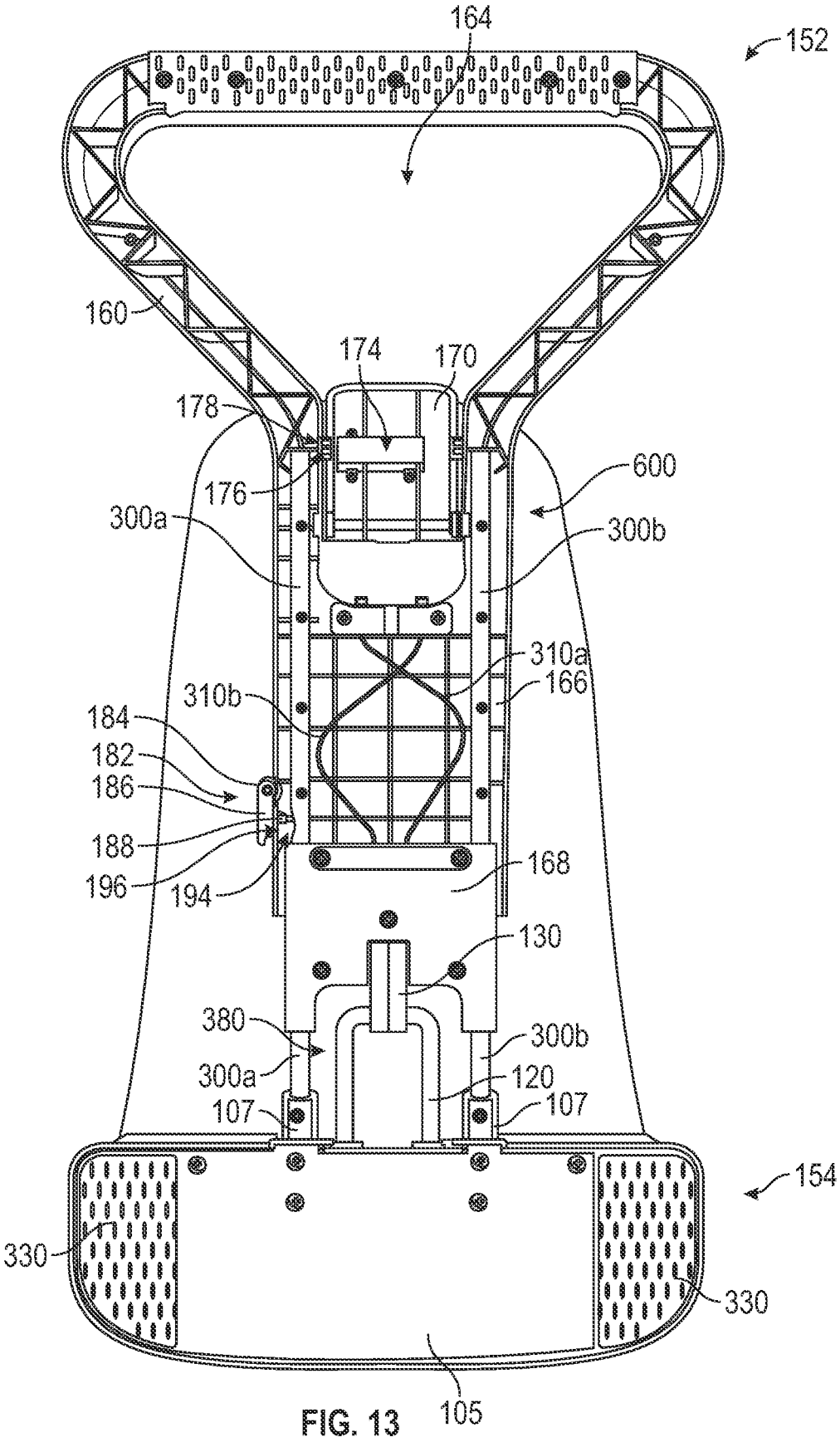
FIG. 13 illustrates a bottom perspective view of the frame, in some embodiments.

As depicted in the bottom perspective view of FIG. 13, frame 100 may also include feet 330, which may include a lower friction-inducing surface, such as a rubberized coating to prevent the bouncer from moving on the floor. The feet 330 may be located at any position on the bottom surface of frame 100, including at each of proximal end 154 and distal end 152 of telescopic base 150, or any position disposed therebetween.

Upper Support

As described above and as best illustrated in FIGS. 7-13, frame 100 may comprise an upper support 110. Upper support 110 may be an extending portion of frame 100, extending upwards and away from telescopic base 150, providing for an attachment structure for coupling bouncer seat 200 to frame 100. In some embodiments, upper support 110 may comprise at least one wire limb (or other similar design), which may comprise a bulbous design to provide upper support 110 with a generally oval or egg shape. Such oval shape of upper support 110 may correspond to the generally oval shaping of bouncer seat 200. However, it will be appreciated that the design and shape of upper support 110 may vary, and, depending on the embodiment, may comprise any geometric shape or design.

In some embodiments, upper support 110 may further comprise a base limb 118 (see FIG. 8). Base limb 118 may be a portion of upper support 110 that is adjacent to or in contact with base plate 105 and may comprise a generally planar or straight design or shape, providing a pivotable aspect to upper support 110. As depicted, upper support 110 may couple to telescopic base 150 at proximal end 154. As described above, proximal end may comprise one or more parts or components for rotatably coupling to upper support 110. For example, the proximal end 154 may comprise rotatable connectors 172*a* and 172*b* disposed on base plate 105. Rotatable connectors 172*a* and 172*b* may be configured to operatively attach upper support 110 to telescopic base 150. For example, rotatable connectors 172*a*, 172*b* may comprise a notch or other design for receiving and rotatably holding base limb 118 of upper support 110. Accordingly, rotatable connectors 172*a*, 172*b* may both couple upper support 110 to telescopic base 150 and allow the angle of upper support 110 to change through rotation of upper support 110. Additionally, in some embodiments, rotatable connectors 172*a*, 172*b* may include bolt-on stanchions for connecting the base plate 105 to the upper support 110 and telescopic base 150. In some embodiments, the attachment of upper support 110 to telescopic base 150 may be adjustable, such that the angle of upper support 110 may be changed in relation to telescopic base 150 (see FIGS. 11A-11D).

In some embodiments, upper support 110 may further be rotatably coupled to base plate 105 through one or more stabilizing connectors 107, configured to couple to base limb 118 and to allow base limb 118, and upper support 110, to rotate when coupled. Like the rotatable connectors 172*a*, 172*b* as described above, stabilizing connectors 107 may comprise a notch or other similar design for accepting and securing base limb 118, such as through an interference fit. The design of stabilizing connectors 107 may also comprise a rotatable design, aiding in the rotation of base limb 118 during the adjustment of the angle of upper support 110. As depicted, base plate 105 may comprise two stabilizing connectors 107. In some embodiments, the one or more stabilizing connectors 107 may couple to base limb 118, thereby providing an additional connection point between upper support 110 and telescopic base 150. Accordingly, stabilizing connectors 107 may aid in maintaining the structure of frame 100. Additionally, stabilizing connectors 107 may further aid in maintaining alignment of upper support 110. Even further, stabilizing connectors 107 may also aid in maintaining the position of upper support 110. As further depicted and in some embodiments, base limb 118 may further comprise a bend 120 disposed at roughly the center of base limb 118. As described in greater detail below, bend 120 may engage with a connection limb 130, which may provide a connection point between upper support 110 and extendable member 156.

Upper support 110 may be in contact with and operatively couple to bouncer seat 200, thereby connecting bouncer seat 200 with frame 100. In some embodiments, bouncer seat 200 may wrap around upper support 110 and may remain in place through an interference fit. In further embodiments, bouncer seat 200 may be coupled to upper support 110 through one or more fasteners, including but not limited to any known mechanical fasteners. In even further embodiments, bouncer seat 200 may be coupled to upper support through a combination of fasteners and an interference fit. In even further embodiments, upper support 110 may comprise one or more grooves or locking tabs and bouncer seat 200 may be locked in position through insertion into the one or more grooves or locking tabs. It will be appreciated that any known attachment method may be utilized in connecting bouncer seat 200 to upper support 110.

Actuation Mechanism

In some embodiments, the height (i.e., angle in relation to telescopic base 150) of the upper support 110 may be adjustable (as used herein height and angle may be used interchangeably with respect to upper support 110), providing a caregiver with flexibility and options for seating the infant at multiple positions. In some embodiments, frame 100 may comprise an actuation mechanism 600 for adjusting the height of upper support 110. Actuation mechanism 600 may comprise an actuation pedal 170, cables 310*a*, 310*b*, and a connection limb 130. Broadly, a caregiver may adjust the angle/height of upper support 110 (i.e., along direction 122) by pressing on actuation pedal 170, thereby releasing inner stops within telescopic base allowing for the adjustment of upper support 110, as described in greater detail below.

Actuation Pedal of Actuation Mechanism

As best depicted in FIG. 8, actuation pedal 170 may be a manually operable actuation interface for adjusting the angle and height of upper support 110. As used herein, the height of upper support 110 is the height as measured from a horizontal surface, such as the substrate on which the bouncer is resting. As the angle of the upper support 110 is changed, the height of the upper support also changes accordingly. The various angles/heights of the upper support allow for the infant to be positioned in various seating positions.

In some embodiments, actuation pedal 170 may be a pivotably mounted pedal, lever, or other similar structure. Actuation pedal 170 may be disposed on an accessible portion of frame 100, such that a caregiver may apply a force to actuation pedal 170, thereby causing actuation pedal 170 to pivot. For example, in the illustrated embodiment, actuation pedal 170 may be disposed in the void space 164 of anchor portion 160. In some embodiments, actuation pedal 170 may optionally and/or additionally comprise a gripping aid to aid a caregiver in engaging with actuation pedal 170. For example, rubber padding or other textured surfaces may be located on a portion of the exterior surface of actuation pedal 170. It will be appreciated that actuation pedal 170 may be engaged by a foot, hand, elbow, knee, or other body part of a caregiver to initiate actuation. Accordingly, the force required to engage actuation pedal 170 should be set at a threshold such that a caregiver may manually actuate actuation pedal 170 without the assistance of a tool or other aid.

Connection Limb of Actuation Mechanism

In some embodiments, frame 100 may further comprise a connection limb 130 disposed between telescopic base 150 and upper support 110, providing for a connection between telescopic base 150 and upper support 110. In some embodiments, connection limb 130 may be configured as a generally oval-shaped member comprising a first end 132 that may pivotally attach to a portion of upper support 110 and a second end 134 that may pivotally attach to inner extending portion 168. For example, first end 132 of connection limb 130 may comprise a hole or opening that may surround a portion of base limb 118, thereby pivotally coupling first end 132 to base limb 118. Additionally, second end 134 of connection limb 130 may also comprise a hole or opening for pivotally attaching to a connection point within the interior of inner extending portion 168. It should be understood that the shape and design of connection limb 130 may vary, but any shape or design may be used that provides for pivotable rotation of connection limb 130. Additionally, the length of connection limb 130 may vary and may be dependent on factors including but not limited to the dimensions of upper support 110, the dimensions of base 150, the different heights that upper support 110 may be adjusted to, among other factors, or any combination thereof. By way of non-limiting example, connection limb 130 may comprise a length of about 2 inches to about 8 inches.

In some embodiments, movement of upper support 110 and inner extending portion 168 may be linked, such that movement or adjustment of upper support 110 may cause movement or adjustment of inner extending portion 168 and/or vice versa. Described above, upper support 110 may be connected to inner extending portion 168 through connection limb 130. Through the rotation of connection limb 130, the movement between upper support 110 and inner extending portion 168 may be linked. For example, when the height/angle of upper support 110 is increased, the bend 120 of base limb 118 may rotate in a corresponding manner. Through the coupling between bend 120 and connection limb 130, as bend 120 rotates, connection limb 130 may rotate as well. Further, because of the solid structure of connection limb 130, as the first end 132 moves, second end 134 rotates in a corresponding manner. For example, in transitioning upper support 110 from a more planar angle to a more upright angle, connection limb 130 may also transition from a starting planar angle to a more upright angle. As connection limb 130 moves to a more upright angle, the connection between second end 134 and inner extending portion 168 causes lateral movement of inner extending portion 168 out from outer shell portion 166 and towards base plate 105. In a corresponding manner, as the height/angle of upper support 110 transitions from an upright angle to a more planar angle, connection limb 130 likewise transitions to a flatter angle. The flattening of a detention aid (discussed further below) may push inner extending portion 168 laterally back into outer shell portion 166. Accordingly, in some embodiments, the adjustment of upper support 110 may cause the telescoping of inner extending portion 168. As described in greater detail below, the telescoping of inner extending portion 168 may provide for the stopping and locking of upper support 110 in predetermined positions.

Cables for Releasing Internal Stops

Turning now to FIG. 13, a bottom perspective of frame 100 is depicted, illustrating various portions and components for adjusting the angle/height of upper support 110. For example, FIG. 13 best illustrates the components used for adjusting the angle/height of upper support 110 and locking upper support 110 in position. As best depicted, frame 100 may comprise at least one cable for adjusting the height/angle of upper support 110. For example, frame 100 may comprise two cables 310*a*, 310*b*. In some embodiments, each of cables 310*a*, 310*b* may be located within the interior of the dimensions of outer shell portion 166 and may be coupled to each of actuation pedal 170 and inner extending portion 168. At least a first portion of each of cables 310*a*, 310*b* may be disposed within the dimensions of actuation pedal 170 and at least a second portion of cables 310*a*, 310*b* may be disposed within the dimensions of inner extending portion 168.

In some embodiments, each end of cable 310*a*, 310*b* may engage with a part or component of the actuation pedal 170 for adjusting the height/angle of upper support 110. For example, the first portion of cables 310*a*, 310*b* are disposed within and coupled to actuation pedal 170. Like that of a bicycle, upon actuation of actuation pedal 170, actuation pedal 170 may act as a lever to apply a pressure to cables 310*a*, 310*b* to thereby pull cables 310*a*, 310*b* in a distal direction. The pulling of cables 310*a*, 310*b* may be applied across the entire length of cables 310*a*, 310*b*. The second portion of cables 310*a*, 310*b* may be disposed within the dimensions of inner extending portion 168. Additionally, each of cables 310*a*, 310*b* may be operatively coupled to a push pin (not shown) or other mechanical stopper or actuator which, as described in greater detail below, may be used in adjusting the height/angle of upper support 110. In some embodiments, the push pins may be spring loaded push pin.

In some embodiments, each of the base connection supports 300*a*, 300*b* may comprise openings, void spaces, holes, or other similar openings for receiving a portion of a push pin. For example, when upper support 110 is in a locked position other than a closed position (i.e., the angle of upper support 110 is at approximately zero), the push pins may be at an extended position and be located at least partially within the void space. When in the extended position, the push pins may engage with the void spaces to prevent movement of inner extending portion 168, when in turn, prevents movement of upper support 110. Upon actuation of actuation pedal 170 and pulling of cables 310*a*, 310*b*, the push pins may be retracted from the openings and energy may be stored in the springs of the push pins. When the force applied to the actuation pedal 170 is relieved and the pulling on cables 310*a*, 310*b* subsides, the stored energy in the springs of the push pins may also be released. If the push pins are aligned with an opening in base connection supports 300*a*, 300*b*, the push pins may enter into the opening to lock the inner extending portion 168 in position. If the push pins are not aligned with an opening in base connection supports 300*a*, 300*b*, such as during movement of inner extending portion 168 during adjustment of upper support 110, the push pins may engage with a surface of the base connection supports 300*a*, 300*b*, sliding across the surface. Upon reaching an opening, the push pins may enter and lock in place, thereby preventing any further movement of inner extending portion 168 and by extension, upper support 110.

In some embodiments, each of base connection supports 300*a*, 300*b* may comprise a plurality of openings for receiving the push pins. The number of openings may correspond to the number of pre-determined heights/angles that upper support 110 may be adjusted to. For example, in some embodiments, if upper support 110 may be adjusted to three different angles/heights, each of base connection supports 300*a*, 300*b* may comprise three openings. Further, in embodiments comprising a plurality of openings corresponding to a plurality of pre-determined heights/angles that upper support 110 may be adjusted to, the plurality of openings may be spaced at predetermined locations corresponding to the predetermined height/angle of upper support 110. By way of non-limiting example, the plurality of openings may be spaced apart by approximately half of an inch to approximately two inches apart.

Prior to actuation of actuation pedal 170, upper support 110 may be locked in a position through the inhibition of movement of inner extending portion 168. Upon actuation of actuation pedal 170 and the retraction of the push pins, the inner extending portion 168 may be released from a locked position for lateral movement along base connection supports 300*a*, 300*b*. Accordingly, when the inner extending portion 168 is in a locked position, the upper support 110 may also be in a locked position or otherwise non-adjustable in height/angle. Because the push pins inhibit telescoping of the inner extending portion 168, connection limb 130 is also inhibited in movement, preventing rotation of connection limb 130. By extension, because connection limb 130 is locked in position, the rotation of upper support 110 is also inhibited. Accordingly, even if a force is applied to upper support 110 to adjust the height/angle, upper support 110 will not rotate because connection limb 130 and inner extending portion 168 are locked in position.

Methods and Operation of Use

Turning to FIGS. 11A-11D, different heights/angles of upper support 110 are illustrated. Such adjustments may be made to, for example, adjust the preferred height/angle of upper support 110 for the child or to fold the device for transport. In some embodiments, such as that illustrated in FIGS. 11A-D11, the baby bouncer 10 may be adjusted along direction 122 such that upper support 110 and telescopic base 150 are substantially close together in a closed configuration. Such a configuration may allow for easy transport of the baby bouncer 10 when not supporting a baby.

The number of angles that upper support 110 may be stopped at may vary depending on the embodiment. However, it will be appreciated that the number of stops may be customizable and upper support 110 may be configured to stop at any number of predetermined angles along direction 122. For example, in the illustrated embodiment, upper support 110 may be stopped and locked in position at four different angles along direction 122, including a closed angle at approximately 0 degrees or when substantially level to telescopic base 150. However, the actual number of angles may vary depending on the embodiment, and theoretically any number of angles may be selected.

As described herein, baby bouncer 10 may be used with infants of varying sizes. For safety reasons, certain angles of upper support 110 may be more advantageous for infants of certain ages than other angles. For example, for very young infants, the angle of upper support 110 may be relatively flat, mimicking a lying down position for the infant. As the infant ages, the caregiver may transition and increase the angle of upper support 110. By way of non-limiting example, for a toddler-aged infant, upper support 110 may be positioned so that the infant is at an upright position. Additionally, even at similar ages, infants may have different angle preferences. For example, a toddler-aged infant may prefer to be at a lying down position rather than at an upright position. Accordingly, baby bouncer 10 provides caregivers with flexibility and options for selecting an angle that is preferable for individual infants. Additionally, the angle of upper support 110 may be adapted to comply with regulatory guidelines, governmental requirements, or suggestions, and/or healthcare provider suggestions or recommendations. For example, for young infants or for infants under certain weight thresholds, a healthcare provider may recommend that the angle of upper support 110 should not exceed 45 degrees relative to telescopic base 150. Additionally, government regulations may require the angle of upper support 110 shall not exceed 80 degrees relative to telescopic base 150. It should be understood that the examples provided herein are intended to be illustrative, rather than limiting, and the angle of upper support 110 may be locked or otherwise positioned at any angle relative to telescopic base 150.

In some embodiments, caregiver may actuate actuation pedal 170 to adjust the height/angle of upper support 110 by one position. For example, a caregiver may apply a force to actuation pedal 170 to retract push pins and begin adjusting the height/angle of upper support 110, and by inner extending portion 168. Once the caregiver begins adjusting the upper support 110, the caregiver may relieve the force applied to the actuation pedal 170, thereby relieving the pulling applied to cables 310*a*, 310*b*. As inner extending portion 168 moves along base connection supports 300, the push pins may slide along the surface of base connection supports 300*a*, 300*b* until an opening is reached. Once the opening is reached, the stored energy in push pins causes the push pins to enter the opening, thereby locking inner extending portion 168, and by extension upper support 110, in position. Distinguishing over the prior art, the location of actuation pedal 170 provides caregivers greater flexibility when adjusting the height of upper support 110. Through a pedal design, a caregiver may apply a force to actuation pedal 170 using a single appendage, such as the caregiver's foot. The caregiver may then use another appendage to grasp or hold upper support 110 for adjusting a height. Such a design may be particularly advantageous in allowing a caregiver to adjust the height of upper support 110 while an infant is placed in baby bouncer 10.

In further embodiments, a caregiver may actuate actuation pedal 170 and adjust the height/angle of upper support 110 by multiple positions. For example, if upper support 110 may be adjusted to four different heights/angles, a caregiver may wish to transition upper support 110 from position four to position two without stopping at position three. In some embodiments, the caregiver may continue to apply the force to actuation pedal 170 to skip or move past intermediate stopping positions. For example, to adjust upper support 110 from position four to position two, the caregiver may apply a continuous or extended force to actuation pedal 170 as upper support 110 is transitioned from position four to position two. By continuing to apply the force to actuation pedal 170, the pulling of cables 310*a*, 310*b* maintains retraction of push pins as inner extending portion moves past the opening associated with position three, thereby preventing push pins from entering the opening associated with position three and locking upper support 110 and inner extending portion 168 in position at position three. Upon reaching the opening associated with position two, the caregiver may relieve the force applied to actuation pedal 170, allowing the push pins to enter the opening and lock upper support 110 and inner extending portion 168 in place at position two.

In some embodiments, the adjustable heights/angles of upper support 110 provides caregivers with an improved number of options in usability of baby bouncer 10. For example, a caregiver may actuate actuation pedal 170 to position upper support 110 in a preferred position to place the infant in either insert 250 or the bouncer seat 200. Once the infant is in position and secured through harness 206, the caregiver may place a hand on the upper support 110 and actuate the actuation pedal 170 to move upper support 110 to the infant's preferred angle. Accordingly, in some embodiments, baby bouncer 10 is adjustable while the infant is secured. In some embodiments, in addition to the change of angle of upper support 110, actuation of actuation pedal 170 may also manipulate the length of extendable member 156. For example, actuation of actuation pedal 170 may release a locking of outer shell portion 166 and inner extending portion 168, allowing inner extending portion 168 to retract or extend. For example, when the angle of upper support 110 increases, inner extending portion 168 may extend in response, increasing the overall length of extendable member 156 to provide stability to baby bouncer 10. When the angle of upper support 110 decreases, inner extending portion 168 may retract in response, decreasing the overall length of extendable member 156.

Materials for Manufacturing the Hard Goods

In some embodiments, upper support 110 and/or telescopic base 150 may be constructed from plastic, aluminum, metal, or other rigid material, providing the structure to baby bouncer 10. Additionally, one or more portions of upper support 110 and telescopic base 150 may be constructed from two or more materials. By way of non-limiting example, portions of telescopic base 150 that are intended to contact a person may be constructed from a plastic material, while portions of base that are not intended to come into contact with a person may be constructed from metal. However, it will be appreciated that this example is not intended to be limiting. In some embodiments, the various sub-assemblies, parts, and/or components of frame 100 may be manufactured using a variety of different methods, including but not limited to molding, additive manufacturing, machining, among other methods. Further, in some embodiments, certain parts or components may require materials that are able to withstand certain thresholds of force, torque, or pressure, and may be constructed from metal, steel, aluminum, or other durable materials. Even further, in some embodiments, certain sub-assemblies, parts, and/or components may be manufactured using one method of construction and other sub-assemblies, parts, and/or components may be manufactured using a different method of construction.

Additional or Optional Hard Goods Features

Safety Features

In some embodiments, frame 100 may further comprise additional safety features to provide additional safety to baby bouncer 10. In some embodiments, outer shell portion 166 may further comprise a cushioned padding 180 (see FIG. 9). In some embodiments, cushioned padding 180 may be positioned on a surface location of outer shell portion 166 that generally corresponds to the position that an infant may be located on insert 250 or receiving region 202. Cushioned padding 180 may provide a cushion or soft spot on telescopic base 150 in the event that a failure of the locking mechanism of frame 100 occurs, and upper support 110 unexpectedly falls to a closed position. Cushioned padding 180 may be positioned such that the infant encounters cushioned padding 180 rather than telescopic base 150. Accordingly, the infant may be protected from the force that may occur with the impact of the hard material of telescopic base 150 by contacting cushioned padding 180 instead. The material of padding 180 may vary but may generally be constructed from a cushioned material that is known in the art.

In some embodiments, frame 100 may further comprise an additional safety lock 182. In some embodiments, additional safety lock 182 may be disposed on extendable member 156 of telescopic base 150 and operatively engage with actuation pedal 170. In some embodiments, additional safety lock 182 may be configured and adapted as a secondary locking mechanism or safety mechanism to prevent upper support 110 from closing all the way to a closed position. This may be particularly advantageous when an infant is placed in baby bouncer 10, and a sudden drop in angle could cause pain, discomfort, or injury to the infant. To prevent or reduce this chance, additional safety lock 182 may lock upper support at a position above the closed configuration, thereby preventing upper support 110 from transitioning to the closed position until additional safety lock 182 is disengaged.

In some embodiments, additional safety lock 182 may be a spring loaded, pivotably engageable pin located on an outer surface of outer shell portion 166 that may engage with an opening in one of connecting members 300*a*, 300*b* to prevent upper support 110 from transitioning the closed position until disengaged. At least one of connecting members 300*a*, 300*b* may comprise an opening corresponding in position to the location of additional safety lock 182. Additional safety lock 182 may generally comprise a pivot joint 184, a body 186 and a pin 188 extending away from body 186. The pivot joint 184 may be a spring loaded joint, allowing a caregiver to pivot additional safety lock 182. In a starting position, body 186 may engage with an outer surface of outer shell portion. Outer shell portion 166 may comprise an opening 194 or void space approximate to the position of pin 188, thereby allowing pin 188 to extend into the interior of outer shell portion 166. Connecting member 300*a* may further comprise an opening 196 approximate to the position of pin 188 and opening 194, thereby allowing pin 188 to extend into the interior of connecting member 300*a*. It should be noted that opening 196 may be substantially similar in design to the openings described above with respect to the openings that engage with the push pins of the inner extending portion 168.

The location of additional safety lock 182 may be positioned on telescopic base 150 to prevent the transition of upper support 110 to a closed configuration without manipulation of additional safety lock. In this position, if a caregiver attempts to transition upper support 110 to a closed configuration, the inner extending portion 168 engages with pin 188 as inner extending portion 168 is moved distally. Through the engagement of inner extending portion 168 with pin 188, the upper support 110 is unable to fully transition to a closed position. This may be particularly advantageous if an infant is seated in receiving region 202 to prevent inadvertent closure of upper support 110 which may cause harm to the infant. To transition upper support 110 to the closed configuration, the caregiver may pivot additional safety lock 182, thereby retracting pin 188 from opening 194. Once retracted, inner extending portion 168 may be free to continue distal movement, thereby transitioning upper support 110 to a closed configuration.

In some embodiments, actuation pedal 170 may comprise an actuation safety lock 174 to lock actuation pedal 170 for preventing accidental or inadvertent actuation. In some embodiments, actuation safety lock 174 may be a toggle, switch, button, or other manipulative engagement tool for the caregiver to manually engage. In some embodiments, toggling or actuation of actuation safety lock 174 may cause extension of an actuation lock extending member 176 which may engage with a surface of outer shell portion 166 or which may otherwise prevent the lever effect of actuation pedal 170. In some embodiments, outer shell portion 166 may comprise a shelf 178 or protruding structure that actuation lock extending member 176 may engage with to inhibit auction of actuation pedal. In some embodiments, actuation safety lock 174 may be located on an outer surface of actuation pedal 170, allowing a caregiver to easily access actuation safety lock 174.

Figure 12:
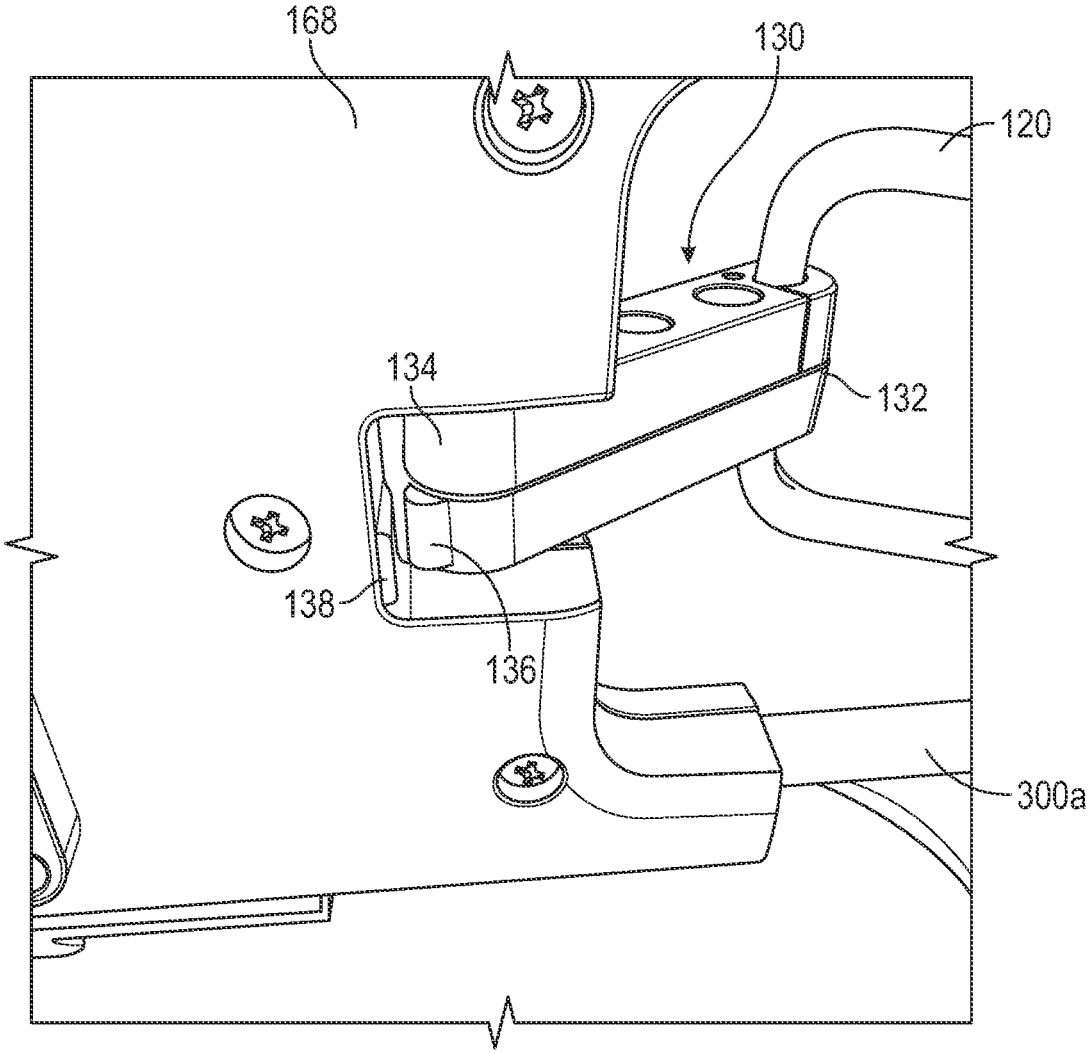
FIG. 12 illustrates a zoomed in perspective of a connection limb and upper support attachment, in some embodiments.

In some embodiments, connection limb 130 may further act as a detention aid to limit or prevent the inadvertent opening of upper support 110 from a closed configuration. As best depicted in FIG. 12, second end 134 of connection limb 130 may also comprise a connection limb extension 136, embossment, protrusion, or other extending member that may engage with a protrusion 138, extension, embodiment, or other extending member of a surface of inner extending portion 168 to provide a detention effect. As described herein, upper support 110 may comprise a closed configuration, in which the angle of upper support 110 is at about 0 degrees relative to telescopic base 150. When at the closed configuration, connection limb extension 136 may engage with the protrusion 138 of inner extending portion 168, providing an interference fit thereby locking upper support 110 in the closed configuration. The amount of force required to overcome the interference fit may vary, but generally, may be overcome by a manual force applied by the caregiver. In response to the applied force, the connection limb extension 136 may disengage with the protrusion 138 of inner extending portion 168, allowing connection limb 130 and upper support 110 to pivotally rotate. Accordingly, a caregiver is not required to use a tool or apparatus to overcome the detention effect created by connection limb 130. Accordingly, a caregiver may transition upper support 110 to a closed configuration for storing baby bouncer 10. Through the detention effect created by connection limb 130, the baby bouncer 10 will not inadvertently open, allowing the caregiver to safely store the baby bouncer 10 without worrying that upper support 110 may inadvertently open from the closed position.

Adjustable Length of Upper Support

Turning to FIG. 10, a side view of frame 100 is depicted. In some embodiments, upper support 110 may be adjustable in length (i.e., direction 114). For example, upper support 110 may include telescopic members 112 forming a substantially oval-shaped frame for receiving the bouncer seat 200 therein. Upper support 110 may include at least one locking mechanism 116 for selectively expanding the length of telescopic member 112 thereof. For example, in some embodiments, locking mechanism 116 may be a lever, threading, pin, or other lock that when released allows a user to move a telescopic members 112 outwards or inwards (i.e., along a direction 114). Such customization may allow a user to adjust the size of bouncer seat 200 for children of different sizes. For example, a user may be able to increase the length of upper support 110 as the infant lengthens. In other embodiments, upper support may not be telescopic and instead be formed of a unitary frame.

Support Shell for Increased Rigidity

Figure 14:
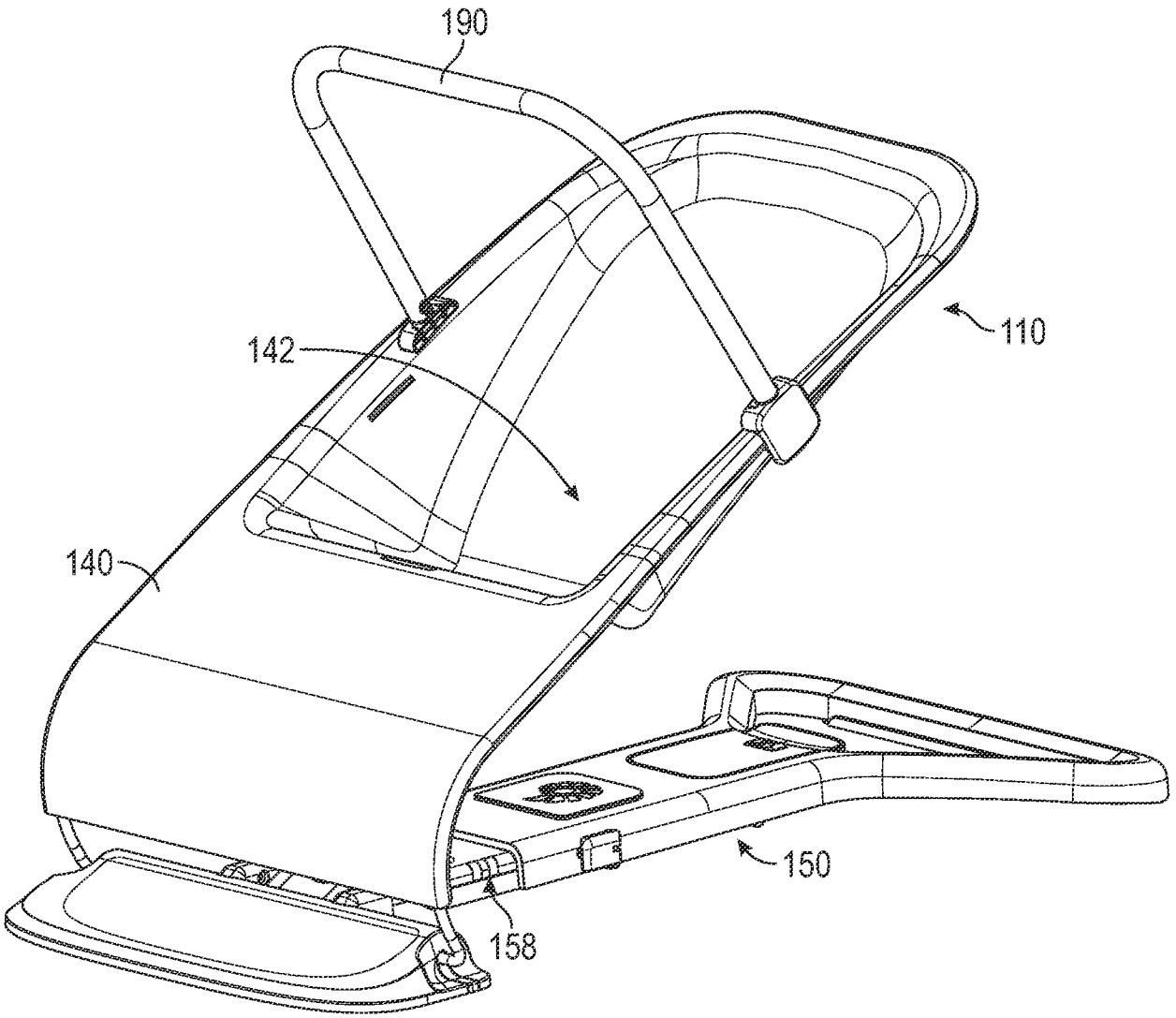
FIG. 14 illustrates an exemplary support shell and entertainment bar for the frame of a baby bouncer, in some embodiments.

As depicted in FIG. 14, and in some embodiments, upper support 110 may optionally or additionally comprise a support shell 140. In some embodiments, support shell 140 may be a generally solid insert, which may provide additional structure or rigidity to baby bouncer 10. Accordingly, support shell 140 may be constructed or manufactured from a solid material, including but not limited to plastic, metal, aluminum, among other materials. Support shell 140 may be disposed within the boundary of telescopic members 112. Support shell 140 may be connected to upper support 110 through a variety of attachment means. For example, support shell 140 may be snapped on to telescopic members 112 and secured through an interference fit. However, any known attachment method, including those described herein may be implemented. Support shell 140 may be used to provide additional rigidity or structure to bouncer seat 200. For example, support shell 140 may be placed on frame 100 prior to attachment of bouncer seat 200. Bouncer seat 200 may be placed over and attached to support shell 140. Through support shell 140, additional rigidity and support may be provided to bouncer seat 200 for supporting the infant. Accordingly, support shell 140 may further comprise a recessed region 142 generally corresponding to the shape and location of receiving region 202 of bouncer seat 200. In some embodiments, support shell 140 may provide additional structure or rigidity to bouncer seat 200, which may aid in supporting older and/or heavier infants.

Entertainment Bar

In some embodiments, frame 100 may further comprise additional entertainment features or parts to provide entertainment to the infant. For example, in some embodiments and depicted in FIG. 14, frame 100 may comprise an optional or additional entertainment bar 190. Entertainment bar 190 may, for example, couple to upper support 110 and may be positioned so that entertainment bar 190 is located above infant while infant is in a seated position. In some embodiments, upper support 110 may comprise one or more locking fasteners for securing entertainment bar 190 to upper support 110. For example, each of telescopic members 112 may comprise a fastener for attaching entertainment bar 190 to. In some embodiments, the fasteners for attaching entertainment bar 190 may be adapted to selectively attach entertainment bar 190 to upper support 110, such that entertainment bar 190 may be selectively attached and detached. In further embodiments, fasteners may be adapted to permanently attach entertainment bar 190 to upper support 110. In some embodiments, entertainment bar 190 may be adapted and configured for attaching one or more toys, visual objects, or other items for entertaining the infant.

Features described above as well as those claimed below may be combined in various ways without departing from the scope thereof. The following examples illustrate some possible, non-limiting combinations:

(A1) A baby bouncer comprising: a telescopic base for positioning the baby bouncer on a support surface, wherein the telescopic base comprises an outer shell portion and an inner extending portion located at least partially within the outer shell portion; an adjustable upper support pivotally coupled to the telescopic base; a connection limb having a first end operatively coupled to the adjustable upper support and a second end operatively coupled to the inner extending portion; an actuation pedal for adjusting an angle of the adjustable upper support in relation to the telescopic base; a bouncer seat removably coupled to the adjustable upper support comprising a receiving area and an attachment pocket; an insert for placement in the receiving area and for receiving an infant comprising at least one retaining member; and a harness assembly for fastening an infant into the bouncer seat. Wherein adjustment of the adjustable upper support causes telescoping of the inner extending portion via the connection limb. Wherein a portion of the harness assembly is inserted through the at least one retaining member of the insert.

(A2) For the baby bouncer denoted as (A1), wherein a distal end of the telescopic base comprises a bulbous anchor having a void space.

(A3) For the baby bouncer denoted as (A1) or (A2), wherein the actuation pedal is located approximate to the distal end of the telescopic base and at least partially within a boundary of the void space of the bulbous anchor.

(A4) For the baby bouncer denoted as any of (A1) through (A3), wherein the inner extending portion comprises at least one visual indicator providing a visual indication when a predetermined angle of the adjustable upper support in relation to the telescopic base is reached.

(A5) For the baby bouncer denoted as any of (A1) through (A4), wherein the adjustable upper support is configured to selectively lock at a plurality of predetermined angles.

(A6) For the baby bouncer denoted as any of (A1) through (A5), wherein the telescopic base comprises a plurality of visual indicators corresponding in number to the plurality of predetermined angles.

(A7) For the baby bouncer denoted as any of (A1) through (A6), wherein at least one predetermined angle of the plurality of predetermined angles is not greater than 45 degrees relative to the telescopic base.

(B1) A baby bouncer comprising: a telescopic base for positioning the baby bouncer on a support surface, wherein the telescopic base comprises an outer shell portion and an inner extending portion located at least partially within the outer shell portion; an adjustable upper support pivotally coupled to the telescopic base; a connection limb having a first end operatively coupled to the adjustable upper support and a second end operatively coupled to the inner extending portion; an actuation pedal for adjusting an angle of the adjustable upper support in relation to the telescopic base; a safety lock disposed on the telescopic base; a bouncer seat removably coupled to the adjustable upper support comprising a receiving area and an attachment pocket; a removable insert for placement in the receiving area and for receiving an infant comprising at least one retaining member; and a harness assembly for fastening an infant into the bouncer seat. Wherein adjustment of the adjustable upper support causes telescoping of the inner extending portion via the connection limb. Wherein the safety lock prevents inadvertent transitioning of the adjustable upper support to a closed configuration. Wherein a portion of the harness assembly is inserted through the at least one retaining member of the removable insert.

(B2) For the baby bouncer denoted as (B1), wherein the safety lock is a pivotable, spring-loaded lock comprising a pin that extends into an interior of the outer shell portion, wherein the pin engages with the inner extending portion at a predetermined location, preventing a movement of inner extending portion past the predetermined location.

(B3) For the baby bouncer denoted as (B1) or (B2), wherein preventing the movement of the inner extending portion past the predetermined location prevents adjustable upper support from transitioning to a closed configuration.

(B4) For the baby bouncer denoted as any of (B1) through (B3), wherein pivoting of the safety lock disengages the pin with the inner extending portion allowing the inner extending portion to move past the predetermined location.

(B5) For the baby bouncer denoted as (B4), wherein the second end of the connection limb comprises an extending portion that engages with a surface of the inner extending portion when the adjustable upper support is in a closed configuration.

(B6) For the baby bouncer denoted as any of (B1) through (B5), wherein engagement of the extending portion and the surface of the inner extending portion provides a detention effect, aiding in maintaining adjustable upper support is in a closed configuration.

(B7) For the baby bouncer denoted as any of (B1) through (B6), wherein the detention effect is overcome by a manually applied force to the adjustable upper support.

(C1) A baby bouncer comprising: a telescopic base for positioning the baby bouncer on a support surface, wherein the telescopic base comprises an outer shell portion and an inner extending portion located at least partially within the outer shell portion; an adjustable upper support pivotally coupled to the telescopic base; a connection limb having a first end operatively coupled to the adjustable upper support and a second end operatively coupled to the inner extending portion; an actuation pedal for adjusting an angle of the adjustable upper support in relation to the telescopic base; a bouncer seat removably coupled to the adjustable upper support comprising a receiving area and an attachment pocket; an insert for placement in the receiving area and for receiving an infant comprising at least one retaining member; and a harness assembly for fastening an infant into the bouncer seat. Wherein adjustment of the adjustable upper support causes telescoping of the inner extending portion via the connection limb. Wherein the insert comprises a head support for maintaining a head of the infant in a neck neutral position. Wherein a portion of the harness assembly is inserted through the at least one retaining member of the insert.

(C2) For the baby bouncer denoted as (C1), wherein the insert is removable for placing and securing the infant directly in the receiving area.

(C3) For the baby bouncer denoted as (C1) or (C2), wherein the receiving area further comprises a head support for maintaining a head of an infant in a neck neutral position.

(C4) For the baby bouncer denoted any of (C1) through (C3), wherein the insert is compatible with infants weighing no greater than approximately 20 pounds.

(C5) For the baby bouncer denoted any of (C1) through (C4), wherein the bouncer seat is compatible with infants weighing no greater than approximately 30 pounds.

(C6) For the baby bouncer denoted as any of (C1) through (C5), wherein the attachment pocket is configured for receiving a portion of the harness assembly.

(D1) An insert for removable attachment to a baby bouncer comprising: a seat portion having padding for supporting at least one leg of an infant; a left-side support and a right-side support for maintaining a position of the infant; a head receiving portion to engage a head of the infant; and a back support portion for providing support to a back of the infant. Wherein the insert is configured for removable attachment to a baby bouncer via a harness.

(D2) For the insert denoted as (D1), wherein the insert is manufactured from a flexible material having a plurality of layers.

(D3) For the insert denoted as (D1) or (D2), wherein the insert comprises a degree of padding inserted between the plurality of layers.

(D4) For the inserted denoted as any of (D1) through (D3), wherein the insert comprises a first degree of padding corresponding to the seat portion, a second degree of padding corresponding the each of the left-side support and the right-side support, a third degree of padding corresponding to the head receiving portion, and a fourth degree of padding corresponding to the back support portion.

(D5) For the inserted denoted as any of (D1) through (D4), wherein the head receiving portion further comprises a head hollow having a lesser degree of padding than the remainder of the head receiving portion.

(D6) For the inserted denoted as any of (D1) through (D5), wherein the head hollow maintains a neck of the infant in a neutral position.

(D7) For the inserted denoted as any of (D1) through (D6), wherein the fourth degree of padding is a mesh material.

(D8) For the inserted denoted as any of (D1) through (D7), wherein the insert comprises a first textured pattern and a second textured pattern.

(D9) For the inserted denoted as any of (D1) through (D8), wherein the first textured pattern is a quilted pattern, and the second textured pattern is a smooth pattern.

(D10) For the inserted denoted as any of (D1) through (D9), wherein the first textured pattern corresponds to each of the head receiving portion and the seat portion and the second textured pattern corresponds to each of the left-side support and the right-side support.

(E1) An insert for removable attachment to a baby bouncer comprising: a seat portion having padding for supporting at least one leg of an infant; a left-side support and a right-side support for maintaining a position of the infant; a head receiving portion to engage a head of the infant; and a back support portion for providing support to a back of the infant. Wherein the seat portion comprises a first retaining member disposed approximate to a front facing side of the insert for receiving a harness. Wherein the insert is configured for removable attachment to a baby bouncer via the harness.

(E2) For the insert denoted as (E1), wherein the harness is a 3-point harness having a first arm, a second arm, and a third arm.

(E3) For the insert denoted as (E1) or (E2), wherein the first arm of the harness is inserted into the first retaining member for securing the infant insert to the baby bouncer (E4) For the inserted denoted as any of (E1) through (E3), further comprising: a second retaining member located on the left-side support and disposed approximate to the front facing side of the insert and a third retaining member located on the right-side support and disposed approximate to the front facing side of the insert.

(E5) For the inserted denoted as any of (E1) through (E4), wherein the second arm of the harness is inserted into the second retaining member and the third arm of the harness is inserted into the third retaining member for securing the infant insert to the baby bouncer.

(E6) For the inserted denoted as any of (E1) through (E5), wherein the harness is a five-point harness having a first arm, a second arm, a third arm, a fourth arm, and a fifth arm.

(E7) For the inserted denoted as any of (E1) through (E6), further comprising a second retaining member, a retaining member, a fourth retaining member, and a fifth retaining member.

(E8) For the inserted denoted as any of (E1) through (E7), wherein the second arm of the harness is inserted into the second retaining member and the third arm of the harness is inserted into the third retaining member, the fourth arm of the harness is inserted into the fourth retaining member, and the fifth arm is inserted into the fifth retaining member for securing the infant insert to the baby bouncer.

(F1) An insert for removable attachment to a baby bouncer comprising: a seat portion having padding for supporting at least one leg of an infant, a left-side support and a right-side support for maintaining a position of the infant; a head receiving portion to engage a head of the infant; a back support portion for providing support to a back of the infant, and at least one retaining member for receiving a harness. Wherein the harness comprises a plurality of arms. Wherein the insert is configured for removable attachment to a baby bouncer via the harness. Wherein the insert comprises a number of retaining members corresponding to the plurality of arms of the harness and wherein each arm of the plurality of arms of the harness is inserted into one retaining member.

(F2) For the insert denoted as (F1), wherein the insert is compatible with infants weighing no greater than approximately 20 pounds.

Although the present disclosure has been described with reference to the embodiments illustrated in the attached drawing figures, it is noted that equivalents may be employed, and substitutions made herein without departing from the scope of the present disclosure as recited in the claims.

Having thus described various embodiments, what is claimed as new and desired to be protected by Letters Patent includes the following:

The invention claimed is:

1. An insert for removable securement to a baby bouncer, wherein the baby bouncer comprises a seat having a receiving area and a harness for retaining an infant in the receiving area of the bouncer and wherein the seat of the baby bouncer is sized and dimensioned for holding an infant at a first weight, the insert comprising:

an insert body sized and shaped to be removably received within the receiving area of the seat of the baby bouncer;

said insert body comprising:

a lower portion having left and right sides, left and right side supports structurally extending upwards from the lower portion and positioned on the respective left and right sides of the lower portion, a back support structurally extending upwards from the lower portion and positioned intermediate of the left and right side supports, wherein the lower portion is configured for receipt of the infant's buttocks, the back support is configured for receipt of the infant's back, a head support configured for receipt of the infant's head, the head support structurally extending upwards from the back support, a head hollow formed in the head support for receipt of at least a portion of the infant's head, wherein the head support has an exterior surface presenting a plane, wherein the head hollow presents a structural depression relative to the plane of the head support, wherein the head hollow includes an interior rear wall, a sidewall surrounding a perimeter of the interior rear wall, and an edgewall surrounding a perimeter of the sidewall and adjacent the exterior surface of the head support, wherein the interior rear wall presents a most depressed portion of the head hollow relative to the plane of the head support, such that the interior rear wall presents a portion of the head hollow farthest away from the plane of the head support, wherein a distance between the most depressed area of the interior rear wall of the head hollow and the plane of the head support is less than 20 mm; and a retaining member secured to the insert body and for removably interfacing with the harness of the baby bouncer to thereby retain the insert body in the receiving area of the seat of the baby bouncer, wherein use of the insert in the seat of the baby bouncer provides for use of the baby bouncer with the infant when the infant is at a second weight, where the second weight is less than the first weight.

2. The insert of claim 1, wherein coupling via the retaining member provides a floating or sliding effect between the insert and the baby bouncer.

3. The insert of claim 1, wherein the retaining member is a loop fixedly secured to the lower portion of the insert body at two or more connection points on the lower portion and presenting a void space disposed between the two or more connection points.

4. The insert of claim 1, wherein the sidewall is angled away from the interior rear wall and towards the plane of the head support.

5. The insert of claim 1, wherein the edgewall presents a line of demarcation between the plane of the head support and the head hollow.

6. The insert of claim 4, wherein the sidewall gradually merges with the interior rear wall, such that there is not a distinct line of demarcation between the interior rear wall and the sidewall.

7. An insert for removable securement to a baby bouncer, wherein the baby bouncer comprises a seat having a receiving area and a harness for retaining an infant in the receiving area of the bouncer and wherein the seat of the baby bouncer is sized and dimensioned for holding an infant at a first weight, the insert comprising:

an insert body sized and shaped to be removably received within the receiving area of the seat of the baby bouncer;

said insert body comprising:

a lower portion having left and right sides, left and right side supports structurally extending upwards from the lower portion and positioned on the respective left and right sides of the lower portion, a back support structurally extending upwards from the lower portion and positioned intermediate of the left and right side supports, and a head support structurally extending upwards from the back support, wherein the lower portion is configured for receipt of the infant's buttocks, the back support is configured for receipt of the infant's back, and the head support is configured for receipt of the infant's head; and a head hollow formed in the head support for receipt of at least a portion of the infant's head to thereby retain the infant's head in a neutral position, wherein the head support has an exterior surface presenting a plane, wherein the head hollow presents a structural depression relative to the plane of the head support; and a retaining member secured to the insert body and for removably interfacing with the harness of the baby bouncer to thereby retain the insert body in the receiving area of the seat of the baby bouncer, wherein the retaining member presents a void space between the insert body and the seat of the baby bouncer when the insert is positioned in the receiving area of the bouncer seat, wherein a first portion of the harness feeds through the void space to thereby at least partially retain the insert body in the receiving area of the bouncer seat, wherein use of the insert in the seat of the baby bouncer provides for use of the baby bouncer with the infant when the infant is at a second weight, where the second weight is less than the first weight.

8. The insert of claim 7, wherein the harness is a three-point harness comprising a T-shaped configuration.

9. The insert of claim 7, wherein the lower portion of the insert body further comprises a depressed region for receipt of the infant's buttocks and a raised region for receipt of the infant's legs, wherein the raised region elevates the infant's knees relative to the infant's buttocks, wherein the retaining member is located on the raised region.

10. The insert of claim 7, wherein the head hollow includes an interior rear wall, a sidewall surrounding a perimeter of the interior rear wall, and an edgewall surrounding a perimeter of the sidewall and adjacent the exterior surface of the head support, and wherein the interior rear wall presents a most depressed portion of the head hollow relative to the plane of the head support, such that the interior rear wall presents a portion of the head hollow farthest away from the plane of the head support.

11. The insert of claim 10, wherein the sidewall is angled away from the interior rear wall and towards the plane of the head support, wherein the sidewall gradually merges with the interior rear wall, such that there is not a distinct line of demarcation between the interior rear wall and the sidewall, and wherein the edgewall presents a line of demarcation between the plane of the head support and the head hollow.

12. The insert of claim 7, wherein the lower portion of the insert body comprises a first degree of padding, each of the respective left and right side supports comprises a second degree of padding, and the back support comprises a third degree of padding.

13. The insert of claim 12, wherein the back support is constructed from a flexible material configured for flexing responsive to the insert receiving the infant.

14. The insert of claim 7, wherein the retaining member is a first retaining member positioned on the lower portion of the insert body, further comprising second and third retaining members positioned on respective left and right side supports of the insert body.

15. The insert of claim 7, wherein the retaining member is a loop fixedly secured to the lower portion of the insert body at two or more connection points on the lower portion and presenting the void space disposed between the two connection points.

16. A method of instructing removably securing an insert in a baby bouncer, wherein the baby bouncer comprises a seat having a receiving area and a harness for retaining an infant in the receiving area of the bouncer and wherein the seat of the baby bouncer is sized and dimensioned for holding an infant at a first weight, the method comprising the steps of:

providing the insert comprising an insert body sized and shaped to be removably received within the receiving area of the seat of the baby bouncer;

said insert body comprising:

a lower portion having left and right sides, left and right side supports structurally extending upwards from the lower portion and positioned on the respective left and right sides of the lower portion, a back support structurally extending upwards from the lower portion and positioned intermediate of the left and right side supports, and a head support structurally extending upwards from the back support, wherein the lower portion is configured for receipt of the infant's buttocks, the back support is configured for receipt of the infant's back, and the head support is configured for receipt of the infant's head; and a retaining member secured to the insert body and for removably interfacing with the harness of the baby bouncer to thereby retain the insert body in the receiving area of the seat of the baby bouncer;

instructing placement of the insert body in the receiving area of the bouncer seat; and instructing interfacing of the harness with the retaining member, wherein use of the insert in the seat of the baby bouncer provides for use of the baby bouncer with the infant when the infant is at a second weight, where the second weight is less than the first weight.

17. The method of claim 16, wherein the retaining member is a first retaining member positioned on the lower portion of the insert body, wherein the insert further comprises second and third retaining members positioned on respective left and right side supports of the insert body.

18. The method of claim 17, further comprising the step of:

instructing interfacing of a first portion of the harness with the first retaining member, a second portion of the harness with the second retaining member, and a third portion of the harness with the third retaining member.

19. The method of claim 18, further comprising the step of:

instructing removable securement of the first portion of the harness with the bouncer.

20. The method of claim 19, wherein the step of instructing removable securement of the first portion of the harness with the bouncer is instructed prior to the step of instructing interfacing of the first portion of the harness with the first retaining member.

21. The method of claim 16, further comprising:

instructing removal of the insert from the receiving area of the bouncer seat when the infant's weight exceeds a pre-determined threshold associated with the second weight.

22. The method of claim 21, further comprising:

instructing interfacing of the harness with the baby bouncer without interfacing with the insert, wherein use of the baby bouncer without the insert provides for use of the baby bouncer with the infant when the infant's weight exceeds the pre-determined threshold associated with the second weight.

23. An insert for removable securement to a baby bouncer, wherein the baby bouncer comprises a seat having a receiving area and a harness for retaining an infant in the receiving area of the bouncer and wherein the seat of the baby bouncer is sized and dimensioned for holding an infant at a first weight, the insert comprising:

an insert body sized and shaped to be removably received within the receiving area of the seat of the baby bouncer;

said insert body comprising:

a lower portion having left and right sides, left and right side supports structurally extending upwards from the lower portion and positioned on the respective left and right sides of the lower portion, a back support structurally extending upwards from the lower portion and positioned intermediate of the left and right side supports, and a head support structurally extending upwards from the back support, wherein the lower portion is configured for receipt of the infant's buttocks, the back support is configured for receipt of the infant's back, and the head support is configured for receipt of the infant's head; and a head hollow formed in the head support for receipt of at least a portion of the infant's head to thereby retain the infant's head in a neutral position, wherein the head support has an exterior surface presenting a plane, wherein the head hollow presents a structural depression relative to the plane of the head support;

a first retaining member secured to the insert body and for removably interfacing with the harness of the baby bouncer to thereby retain the insert body in the receiving area of the seat of the baby bouncer, wherein the first retaining member is positioned proximate the lower portion of the insert body; and a second retaining member positioned proximate the left side support of the insert body; and a third retaining member positioned proximate the right side support of the insert body, wherein use of the insert in the seat of the baby bouncer provides for use of the baby bouncer with the infant when the infant is at a second weight, where the second weight is less than the first weight.

24. The insert of claim 23, wherein the head hollow includes an interior rear wall, a sidewall surrounding a perimeter of the interior rear wall, and an edgewall surrounding a perimeter of the sidewall and adjacent the exterior surface of the head support, and wherein the interior rear wall presents a most depressed portion of the head hollow relative to the plane of the head support, such that the interior rear wall presents a portion of the head hollow farthest away from the plane of the head support.

25. The insert of claim 24, wherein the sidewall is angled away from the interior rear wall and towards the plane of the head support, wherein the sidewall gradually merges with the interior rear wall, such that there is not a distinct line of demarcation between the interior rear wall and the sidewall, and wherein the edgewall presents a line of demarcation between the plane of the head support and the head hollow.

26. The insert of claim 25, wherein the sidewall is angled away from the interior rear wall and towards the plane of the head support.

27. The insert of claim 24, wherein the edgewall presents a line of demarcation between the plane of the head support and the head hollow.

28. The insert of claim 23, wherein the first retaining member is a loop fixedly secured to the lower portion of the insert body at two or more connection points on the lower portion and presenting a void space disposed between the two connection points.

29. The insert of claim 28, wherein the second retaining member presents a second void space and the third retaining member presents a third void space, wherein a second portion of the harness feeds through the second void space and a third portion of the harness feeds through the third void space.

* * * * *